US011164543B1

(12) United States Patent
Gao et al.

(10) Patent No.: US 11,164,543 B1
(45) Date of Patent: Nov. 2, 2021

(54) METHOD AND DEVICE FOR BRIGHTNESS COMPENSATION OF DISPLAY PANEL, AND DISPLAY DEVICE

(71) Applicant: Wuhan Tianma Micro-Electronics Co., Ltd., Wuhan (CN)

(72) Inventors: Xiangyu Gao, Wuhan (CN); Jingxiong Zhou, Wuhan (CN); Guang Wang, Wuhan (CN)

(73) Assignee: Wuhan Tianma Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 17/072,190

(22) Filed: Oct. 16, 2020

(30) Foreign Application Priority Data

Aug. 17, 2020 (CN) ..... 202010823664.3

(51) Int. Cl.
*G09G 5/10* (2006.01)
*G09G 3/20* (2006.01)
*G09G 3/3208* (2016.01)

(52) U.S. Cl.
CPC ..... *G09G 5/10* (2013.01); *G09G 3/2074* (2013.01); *G09G 3/3208* (2013.01); *G09G 2300/0452* (2013.01); *G09G 2310/08* (2013.01); *G09G 2320/0233* (2013.01); *G09G 2320/045* (2013.01); *G09G 2330/021* (2013.01)

(58) Field of Classification Search
CPC ..... G09G 5/10
See application file for complete search history.

(56) References Cited

U.S. PATENT DOCUMENTS

2011/0199395 A1* 8/2011 Nathan ..... G09G 3/3241 345/690

FOREIGN PATENT DOCUMENTS

| | | | |
|---|---|---|---|
| CN | 104464626 | A | 3/2015 |
| CN | 106847157 | A | 6/2017 |
| CN | 107274834 | A | 10/2017 |
| CN | 111179832 | A | 5/2020 |

* cited by examiner

*Primary Examiner* — Gustavo Polo
(74) *Attorney, Agent, or Firm* — Anova Law Group, PLLC

(57) ABSTRACT

A method and a device for brightness compensation of a display panel, and a display device are provided. The method includes obtaining a brightness degradation rate of each sub-pixel of a plurality of sub-pixels of the display panel at a first gray-scale value. The method also includes determining whether brightness degradation rates of the plurality of sub-pixels include a brightness degradation rate greater than a first preset threshold, and whether a proportion of sub-pixels, having brightness degradation rates greater than the first preset threshold, over the plurality of sub-pixels is greater than a preset percentage. Further, the method includes performing brightness compensation on the display panel according to one of a first brightness compensation method (increasing brightness of at least a portion of the plurality of sub-pixels) and a second brightness compensation method (reducing brightness of at least a portion of the plurality of sub-pixels).

20 Claims, 12 Drawing Sheets

METHOD AND DEVICE FOR BRIGHTNESS COMPENSATION OF DISPLAY PANEL, AND DISPLAY DEVICE

CROSS-REFERENCE TO RELATED APPLICATION

This application claims the priority of Chinese patent application No. 202010823664.3, filed on Aug. 17, 2020, the entirety of which is incorporated herein by reference.

FIELD

The present disclosure generally relates to the field of display technology and, more particularly, relates to method and device for brightness compensation of a display panel, and a display device.

BACKGROUND

An organic light-emitting diode (OLED) display panel is featured with advantages such as self-illumination, high contrast, high color gamut, wide viewing angle, light and thin structure, and flexible compatibility, etc., which has attracted more and more attention from the display industry.

In a related technology, an OLED light-emitting device in an OLED display panel often includes an anode, a light-emitting layer, and a cathode. Further, the light-emitting layer is made of an organic material capable of emitting light driven by a current. However, the organic material of the light-emitting layer in the OLED light-emitting device will gradually age as the use time extends, causing decrease in the brightness uniformity of the OLED display panel. The disclosed device and method are directed to solve one or more problems set forth above and other problems.

SUMMARY

One aspect of the present disclosure provides a method for brightness compensation of a display panel. The method includes obtaining a brightness degradation rate of each sub-pixel of a plurality of sub-pixels of the display panel at a first gray-scale value. The brightness degradation rate is a ratio of an attenuated brightness value over an original maximum brightness value of a sub-pixel at the first gray-scale value, the original maximum brightness value is an initial brightness value of the sub-pixel at the first gray-scale value, and the attenuated brightness value is a difference between the original maximum brightness value and a current brightness value of the sub-pixel at the first gray-scale value. The method also includes determining whether brightness degradation rates of the plurality of sub-pixels include a brightness degradation rate greater than a first preset threshold, and whether a proportion of sub-pixels, having brightness degradation rates greater than the first preset threshold, over the plurality of sub-pixels is greater than a preset percentage. In addition, the method includes in response to the proportion of the sub-pixels, having the brightness degradation rates greater than the first preset threshold, over the plurality of sub-pixels being not greater than the preset percentage, performing brightness compensation on the display panel according to a first brightness compensation method. Further, the method includes in response to the proportion of the sub-pixels, having the brightness degradation rates greater than the first preset threshold, over the plurality of sub-pixels being greater than the preset percentage, performing brightness compensation on the display panel according to a second brightness compensation method. The first brightness compensation method includes increasing brightness of at least a portion of the plurality of sub-pixels in the display panel. The second brightness compensation method includes reducing brightness of at least a portion of the plurality of sub-pixels in the display panel.

Another aspect of the present disclosure provides a device for brightness compensation of a display panel. The device includes a brightness degradation rate acquisition unit, a determination unit, and a compensation unit. The brightness degradation rate acquisition unit is configured to obtain a brightness degradation rate of each sub-pixel of a plurality of sub-pixels of the display panel at a first gray-scale value. The brightness degradation rate is a ratio of an attenuated brightness value over an original maximum brightness value of a sub-pixel at the first gray-scale value. The original maximum brightness value is an initial brightness value of the sub-pixel at the first gray-scale value. The attenuated brightness value is a difference between the original maximum brightness value and a current brightness value of the sub-pixel at the first gray-scale value. The determination unit is configured to determine whether brightness degradation rates of the plurality of sub-pixels include a brightness degradation rate greater than a first preset threshold, and whether a proportion of sub-pixels, having brightness degradation rates greater than the first preset threshold, over the plurality of sub-pixels is greater than a preset percentage. The compensation unit is configured to in response to the proportion of the sub-pixels, having the brightness degradation rates greater than the first preset threshold, over the plurality of sub-pixels being not greater than the preset percentage, perform brightness compensation on the display panel according to a first brightness compensation method; or in response to the proportion of the sub-pixels, having the brightness degradation rates greater than the first preset threshold, over the plurality of sub-pixels being greater than the preset percentage, perform brightness compensation on the display panel according to a second brightness compensation method. The first brightness compensation method includes increasing brightness of at least a portion of the plurality of sub-pixels in the display panel. The second brightness compensation method includes reducing brightness of at least a portion of the plurality of sub-pixels in the display panel.

Another aspect of the present disclosure provides a display device. The display device includes a device for brightness compensation of a display panel. The device includes a brightness degradation rate acquisition unit, a determination unit, and a compensation unit. The brightness degradation rate acquisition unit is configured to obtain a brightness degradation rate of each sub-pixel of a plurality of sub-pixels of the display panel at a first gray-scale value. The brightness degradation rate is a ratio of an attenuated brightness value over an original maximum brightness value of a sub-pixel at the first gray-scale value. The original maximum brightness value is an initial brightness value of the sub-pixel at the first gray-scale value. The attenuated brightness value is a difference between the original maximum brightness value and a current brightness value of the sub-pixel at the first gray-scale value. The determination unit is configured to determine whether brightness degradation rates of the plurality of sub-pixels include a brightness degradation rate greater than a first preset threshold, and whether a proportion of sub-pixels, having brightness degradation rates greater than the first preset threshold, over the plurality of sub-pixels is greater than a preset percentage.

The compensation unit is configured to in response to the proportion of the sub-pixels, having the brightness degradation rates greater than the first preset threshold, over the plurality of sub-pixels being not greater than the preset percentage, perform brightness compensation on the display panel according to a first brightness compensation method; or in response to the proportion of the sub-pixels, having the brightness degradation rates greater than the first preset threshold, over the plurality of sub-pixels being greater than the preset percentage, perform brightness compensation on the display panel according to a second brightness compensation method. The first brightness compensation method includes increasing brightness of at least a portion of the plurality of sub-pixels in the display panel. The second brightness compensation method includes reducing brightness of at least a portion of the plurality of sub-pixels in the display panel.

Other aspects of the present disclosure can be understood by those skilled in the art in light of the description, the claims, and the drawings of the present disclosure.

BRIEF DESCRIPTION OF THE DRAWINGS

To more clearly illustrate the embodiments of the present disclosure, the drawings will be briefly described below. The drawings in the following description are certain embodiments of the present disclosure, and other drawings may be obtained by a person of ordinary skill in the art in view of the drawings provided without creative efforts.

DETAILED DESCRIPTION OF THE DISCLOSURE

Reference will now be made in detail to exemplary embodiments of the disclosure, which are illustrated in the accompanying drawings. Wherever possible, the same reference numbers will be used throughout the drawings to refer to the same or the alike parts. The described embodiments are some but not all of the embodiments of the present disclosure. Based on the disclosed embodiments, persons of ordinary skill in the art may derive other embodiments consistent with the present disclosure, all of which are within the scope of the present disclosure.

It should be noted that relational terms such as first and second may be merely used to distinguish one entity or operation from another entity or operation, and may not require or imply that such entities or operations have any actual relationship or order. Moreover, the terms "include", "contain" or any variant may be intended to cover non-exclusive inclusion, such that a process, a method, an article, or a device that includes a series of elements may not only include such elements, but also include any other element that is not clearly listed, or may include elements inherent to such process, method, article or device. In a case without more restrictions, the element defined by the sentence "including . . . " may not exclude the existence of any other same element in the process, method, article, or device that includes the element.

The present disclosure provides a method for brightness compensation of a display panel, a device for brightness compensation of a display panel, and a display device. The display panel may be an OLED display panel, which may include an OLED light-emitting component. Various embodiments of the present disclosure may be described below with accompanying drawings.

Figure 1:
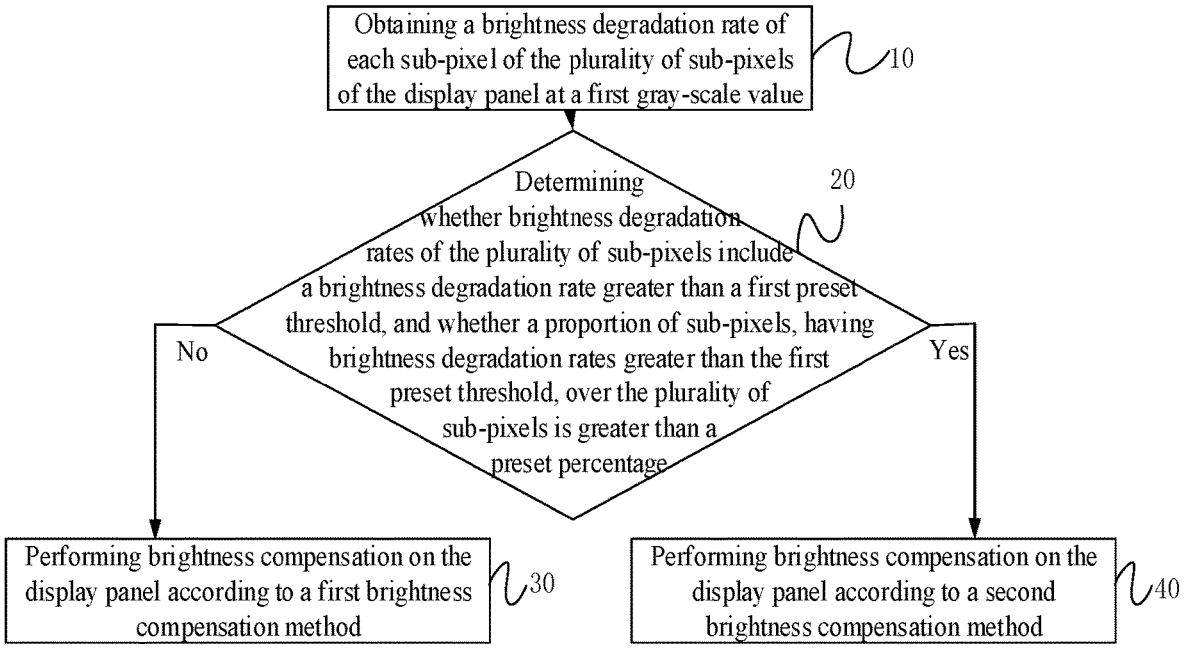
FIG. 1 illustrates a schematic flowchart of an exemplary method for brightness compensation of a display panel consistent with disclosed embodiments of the present disclosure.

FIG. 1 illustrates a schematic flowchart of a method for brightness compensation of a display panel consistent with disclosed embodiments of the present disclosure. Referring to FIG. 1, the method for brightness compensation of the display panel provided by the disclosed embodiments of the present disclosure may include steps 10-40.

In step 10: obtaining a brightness degradation rate of each sub-pixel of a plurality of sub-pixels of the display panel at a first gray-scale value.

In one embodiment, the display panel may include a plurality of pixels, and each pixel may include sub-pixels of various colors. For example, each pixel may include three primary color sub-pixels, namely a red sub-pixel, a green sub-pixel, and a blue sub-pixel. Step 10 may specifically include obtaining the brightness degradation rates of each red sub-pixel, each green sub-pixel, and each blue sub-pixel of the display panel at the first gray-scale value.

In one embodiment, if data storage bits of the display panel are 8 bit, a quantity of gray-scale values may be $2^8$, in other words, the gray-scale value may include 0-255, and the first gray-scale value may be any one gray-scale value from 0-255. In one embodiment, the first gray-scale value may be 255 as an example. The data storage bits of the display panel may include any other value, e.g., 12 bit, 16 bit, etc.

Due to characteristics of the organic material in a light-emitting layer of the sub-pixel, the sub-pixel may gradually age as the use time extends, in other words, the brightness of the sub-pixel at a same gray-scale value may gradually decrease as the use time extends. In the present disclosure, the brightness degradation rate may refer to a ratio of an attenuated brightness value over an original maximum brightness value of the sub-pixel at the first gray-scale value. The original maximum brightness value may refer to an initial brightness value of the sub-pixel at the first gray-scale value. The attenuated brightness value may refer to a difference between the original maximum brightness value and the current brightness value of the sub-pixel at the first gray-scale value.

In one embodiment, the initial brightness value of the sub-pixel at the first gray-scale value may refer to the display brightness value of the sub-pixel at the first gray-scale value of the display panel at the factory, i.e., the brightness value of the sub-pixel without being aged. The current brightness value of the sub-pixel at the first gray-scale value may refer to the brightness value of the aged sub-pixel after the display panel has been used for a period of time. Correspondingly, the attenuated brightness value may refer to the difference between the brightness value of the sub-pixel without being aged and the brightness value of the sub-pixel after being aged.

In one embodiment, the first gray-scale value may be 255, and the initial brightness value of the sub-pixel at the gray-scale value of 255 may be 430 nit. In other words, the original maximum brightness value of the sub-pixel at the gray-scale value of 255 may be 430 nit. After the display panel has been used for a period of time, the sub-pixel may be aged. For example, the current brightness value of the sub-pixel at gray-scale value of 255 may be 410 nit, then, the brightness degradation rate of the sub-pixel at gray-scale value of 255 may be (430−410)/430.

In one embodiment, the original maximum brightness value of each sub-pixel of a same color at the first gray-scale value may be same. The original maximum brightness value of each sub-pixel of a different color at the first gray-scale value may be same, or may be different according to actual requirements, which may not be limited by the present disclosure.

It should be understood that the brightness degradation rate may be a value between 0-1, and the larger the value of the brightness degradation rate, the more serious the brightness degradation of the sub-pixel, i.e., the more serious the sub-pixel being aged. In the present disclosure, the brightness degradation rate may be configured to indicate the brightness degradation condition of the sub-pixel. By obtaining the brightness degradation rate of each sub-pixel, the aged degree of each sub-pixel may be accurately evaluated, such that the brightness compensation may be substantially effectively performed on the display panel.

In step 20: determining whether brightness degradation rates of the plurality of sub-pixels include a brightness degradation rate greater than a first preset threshold, and whether a proportion of sub-pixels, having brightness degradation rates greater than the first preset threshold, over the plurality of sub-pixels is greater than a preset percentage.

In one embodiment, the first preset threshold and the preset percentage may be set according to actual needs, or may be set according to experience. For example, brightness compensation may be performed on a plurality of sample display panels according to the method for brightness compensation of the display panel provided in the present disclosure, and a different first preset threshold and a different preset percentage may be set. The compensation effect at the different first preset threshold and the different preset percentage may be compared, and the first preset threshold and preset percentage corresponding to the better compensation effect may be selected as the values of the first preset threshold and preset percentage used in actual compensation. The compensation effect may include display effect, power consumption, etc., of the compensated sample display panel.

In one embodiment, the first preset threshold may include 5%, 10%, 15%, etc. The preset percentage may include 5%, 10%, 15%, etc. The first preset threshold and the preset percentage may also be any other value, which may not be limited by the present disclosure.

In an optional embodiment, the display panel including a red sub-pixel, a green sub-pixel, and a blue sub-pixels may be used as an example, and the brightness degradation of sub-pixel of each color may be respectively determined. Step 20 may specifically include: determining whether brightness degradation rates of the red sub-pixels include a brightness degradation rate greater than a first preset threshold, and whether a ratio of the quantity of the red sub-pixels having brightness degradation rates greater than the first preset threshold over a total quantity of the red sub-pixels is greater than the preset percentage; determining whether brightness degradation rates of the green sub-pixels include a brightness degradation rate greater than a first preset threshold, and whether a ratio of the quantity of the green sub-pixels having brightness degradation rates greater than the first preset threshold over a total quantity of the green sub-pixels is greater than the preset percentage; and determining whether brightness degradation rates of the blue sub-pixels include a brightness degradation rate greater than a first preset threshold, and whether a ratio of the quantity of the blue sub-pixels having brightness degradation rates greater than the first preset threshold over a total quantity of the blue sub-pixels is greater than the preset percentage.

Because organic light-emitting materials of the red sub-pixel, the green sub-pixel, and the blue sub-pixel are different, the aging rate of the sub-pixel of each color may be different. In step 20, the specific values of the first preset threshold and the preset percentage corresponding to the sub-pixel of each color may be different, to achieve substantially precise compensation for the display panel. To reduce the amount of storage, the specific values of the first preset threshold and the preset percentage corresponding to the sub-pixel of each color may be the same.

In an optional embodiment, the display panel including a red sub-pixel, a green sub-pixel, and a blue sub-pixels may be used as an example, and the brightness degradation of the sub-pixel of each color may be overall determined. Step 20 may specifically include: determining whether brightness degradation rates of the red sub-pixels, the green sub-pixels and the blue sub-pixels include a brightness degradation rate greater than a first preset threshold, and whether a ratio of the quantity of sub-pixels having brightness degradation rates greater than the first preset threshold over a total quantity of sub-pixels is greater than the preset percentage. The total quantity of sub-pixels may be a sum of the quantity of red sub-pixels, the quantity of green sub-pixels, and the quantity of blue sub-pixels. Overall determining the brightness degradation of the sub-pixel of each color may reduce the amount of calculation and improve efficiency.

If the determination result of step 20 is no, i.e., the proportion of the sub-pixels, having the brightness degradation rates greater than the first preset threshold, over the plurality of sub-pixels is not greater than the preset percentage, step 30 may be executed to perform brightness compensation on the display panel according to a first brightness compensation method. If the determination result of step 20 is yes, i.e., the proportion of the sub-pixels, having the brightness degradation rates greater than the first preset threshold, over the plurality of sub-pixels is greater than the preset percentage, step 40 may be executed to perform brightness compensation on the display panel according to a second brightness compensation method. The first brightness compensation method may include increasing the brightness of at least a portion of the plurality of sub-pixels in the display panel, and the second brightness compensation method may include reducing the brightness of at least a portion of the plurality of sub-pixels in the display panel.

The voltage value provided to the sub-pixel may often be positively correlated with the brightness of the sub-pixel. In other words, the greater the voltage provided to the sub-pixel, the greater the brightness of the sub-pixel; and the smaller the voltage provided to the sub-pixel, the smaller the brightness of the sub-pixel. The brightness of the sub-pixel may increase by increasing the voltage provided to the sub-pixel. Similarly, the brightness of the sub-pixel may decrease by reducing the voltage provided to the sub-pixel.

In the present disclosure, if the determination result of step 20 is no, the overall brightness degradation of the sub-pixels of the display panel may not be serious. In view of this, the brightness compensation may be performed on the display panel by increasing the brightness of at least a portion of the sub-pixels in the display panel, which may ensure that the display panel overall may not become dark while improving the brightness uniformity of the display panel.

If the determination result of step 20 is yes, the overall brightness degradation of the sub-pixels of the display panel may be substantially serious. If the brightness compensation is performed on the display panel by increasing the brightness of the sub-pixels in the display panel, a quantity of the sub-pixels that need to increase the brightness may be substantially large, in other words, the quantity of sub-pixels that need to increase the voltage may be substantially large, which may cause the power consumption of the display panel to greatly increase. In view of this, the brightness compensation may be performed on the display panel by reducing the brightness of at least a portion of the sub-pixels in the display panel, which may ensure that while improving the brightness uniformity of the display panel, the power consumption of the display panel may be prevented from being too large.

In the method for brightness compensation of the display panel provided by the present disclosure, by obtaining the brightness degradation rate of each sub-pixel of the display panel at the first gray-scale value, the brightness degradation condition of each sub-pixel of the display panel may be determined. In view of different brightness degradation condition, the brightness compensation may be performed on the display panel according to a different brightness compensation method. While improving the brightness uniformity of the display panel, the brightness of the display panel may be compensated in a targeted manner to achieve a desired compensation effect.

Figure 2:
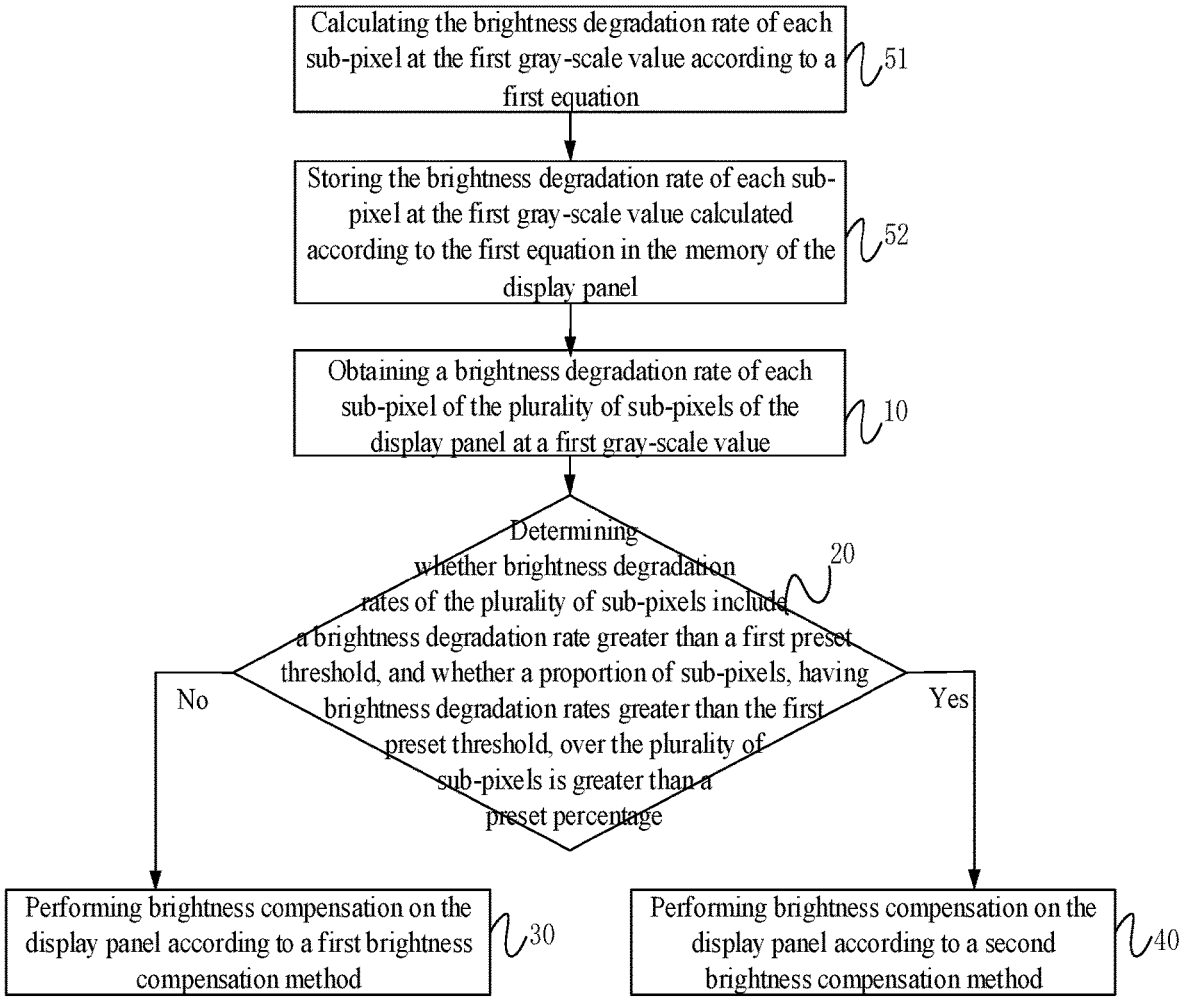
FIG. 2 illustrates a schematic flowchart of another exemplary method for brightness compensation of a display panel consistent with disclosed embodiments of the present disclosure.

FIG. 2 illustrates a schematic flowchart of another method for brightness compensation of a display panel consistent with disclosed embodiments of the present disclosure. The steps in FIG. 2 that are the same as the steps in FIG. 1 may be marked with the same signs. Referring to FIG. 2, before performing step 10, the method for brightness compensation of the display panel provided by the disclosed embodiments associated with FIG. 2 may further include step 51 and step 52.

In step 51: calculating the brightness degradation rate of each sub-pixel at the first gray-scale value according to a relationship (1):

$$\text{Dege} = \frac{L_o - L_{current}}{L_o}, \tag{1}$$

where Dege is the brightness degradation rate of the sub-pixel at the first gray-scale value, $L_o$ is the original maximum brightness value of the sub-pixel at the first gray-scale value, and $L_{current}$ is the current brightness value of the sub-pixel at the first gray-scale value, $L_o - L_{current}$ is the attenuated brightness value of the sub-pixel at the first gray-scale value, and the current brightness value may be the brightness value of the sub-pixel after the brightness is attenuated.

In one embodiment, the original maximum brightness value of the sub-pixel at the first gray-scale value may be pre-stored in the memory of the display panel, such that the original maximum brightness value of the sub-pixel at the first gray-scale value may be directly obtained from the memory of the display panel, and then the brightness degradation rate of the sub-pixel at the first gray-scale value may be calculated according to the above-mentioned relationship (1).

In step 52: storing the brightness degradation rate of each sub-pixel at the first gray-scale value calculated according to the above-mentioned relationship (1) in the memory of the display panel. By storing the brightness degradation rate in the memory of the display panel, when the brightness compensation is performed on the display panel every time, the stored brightness degradation rate may be directly obtained, thereby improving the compensation efficiency.

Figure 3:
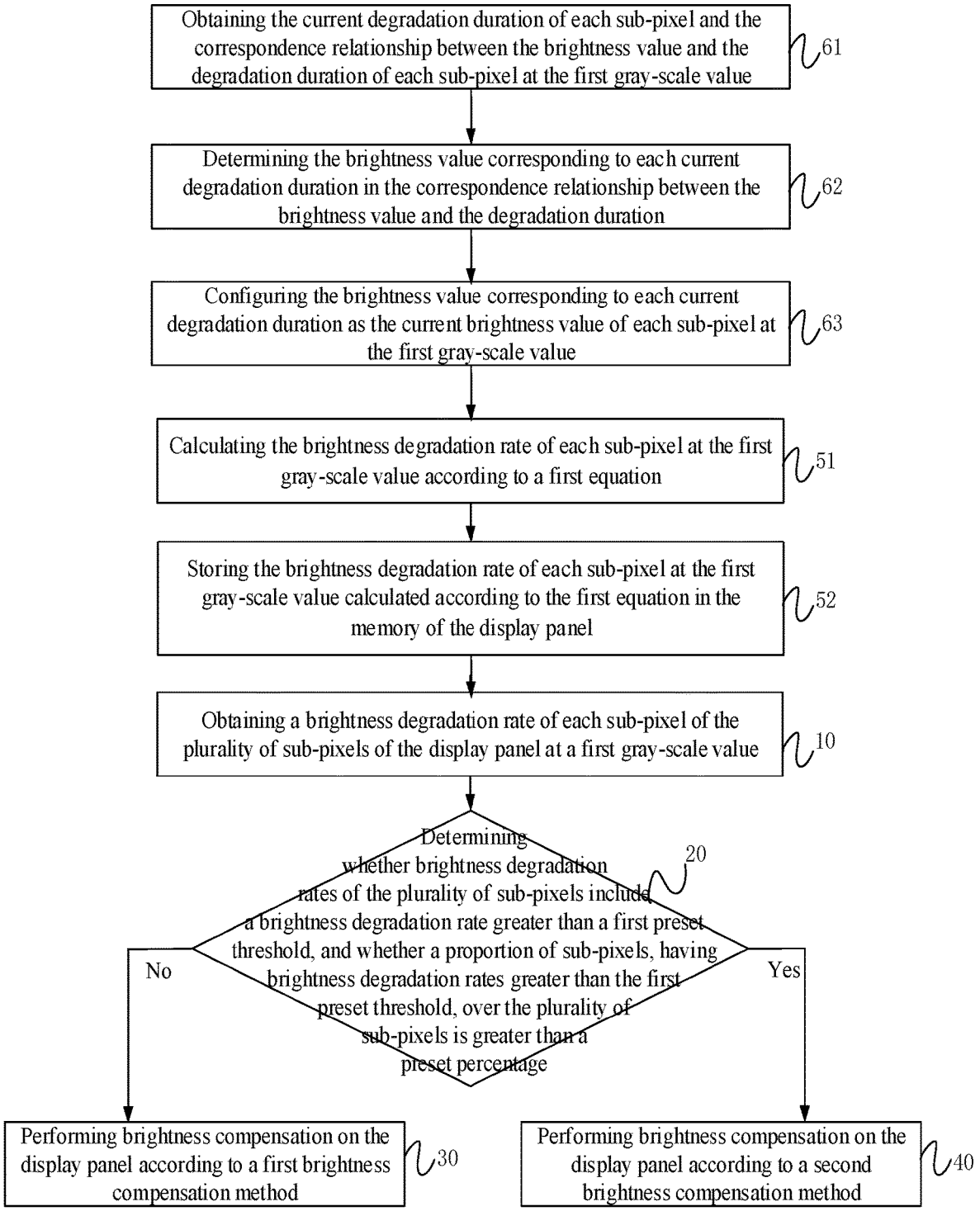
FIG. 3 illustrates a schematic flowchart of another exemplary method for brightness compensation of a display panel consistent with disclosed embodiments of the present disclosure.

FIG. 3 illustrates a schematic flowchart of another method for brightness compensation of a display panel consistent with disclosed embodiments of the present disclosure. The steps in FIG. 3 that are the same as the steps in FIG. 2 may be marked with the same signs. Referring to FIG. 3, before performing step 51, the method for brightness compensation of the display panel provided by the disclosed embodiments associated with FIG. 3 may further include steps 61-63.

In step 61: obtaining the current degradation duration of each sub-pixel and the correspondence relationship between the brightness value and the degradation duration of each sub-pixel at the first gray-scale value.

In one embodiment, before performing step 61, the current degradation duration of each sub-pixel and the correspondence relationship between the brightness value and the degradation duration of each sub-pixel at the first gray-scale value may be pre-stored in the memory of the display panel. Because the brightness of the sub-pixel gradually decreases as the use time extends, the current degradation duration of the sub-pixel may be related to the total display duration of the sub-pixel.

Figure 4:
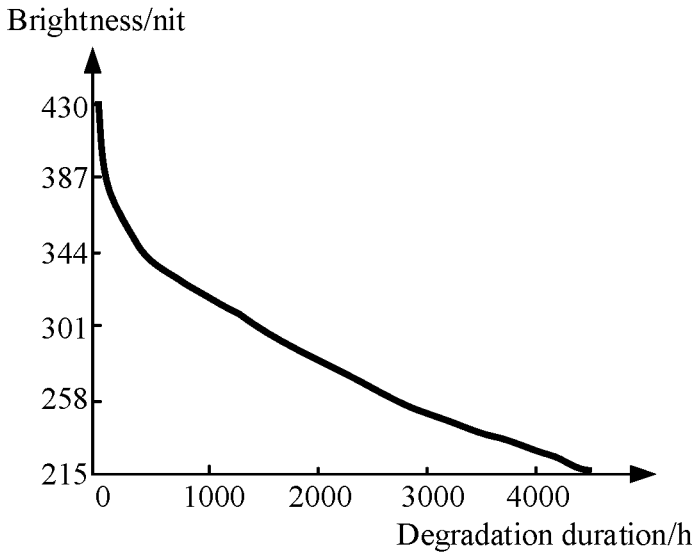
FIG. 4 illustrates a schematic diagram of a correspondence relationship between brightness value and degradation duration of a sub-pixel at a first gray-scale value consistent with disclosed embodiments of the present disclosure.

In one embodiment, an aging test may be performed on the sample display panel in advance. For example, a picture with the first gray-scale value may be inputted into each sub-pixel of the sample display panel, and the brightness of each sub-pixel may be measured at a different display duration, to obtain the correspondence relationship between the brightness value and the degradation duration of each sub-pixel at the first gray-scale value. FIG. 4 illustrates a schematic diagram of a correspondence relationship between the brightness value and the degradation duration of the sub-pixel at the first gray-scale value consistent with disclosed embodiments of the present disclosure. In FIG. 4, the abscissa represents the degradation duration, and the ordinate represents the brightness value. For example, the schematic diagram of the curve as shown in FIG. 4 may be pre-stored in the memory of the display panel.

In step 62: determining the brightness value corresponding to each current degradation duration according to the correspondence relationship between the brightness value and the degradation duration.

In step 63: setting the brightness value corresponding to each current degradation duration as the current brightness value of each sub-pixel at the first gray-scale value.

For example, when the obtained current degradation duration of a sub-pixel is 1000 h, in the schematic diagram of the curve shown in FIG. 4, an ordinate value corresponding to an abscissa value of 1000 h may be obtained, and the ordinate value may be the current brightness value of the sub-pixel at the first gray-scale value.

In the disclosed embodiments of the present disclosure, merely the correspondence relationship between the brightness value and the degradation duration of the sub-pixel at the first gray-scale value may be stored. In other words, merely the correspondence relationship between the brightness value and the degradation duration of the sub-pixel at one gray-scale value may be stored. On the one hand, the storage amount may be reduced, which may save storage resources; and on the other hand, merely the brightness degradation rate of the sub-pixel at the first gray-scale value may be calculated, which may reduce the calculation amount.

Figure 5:
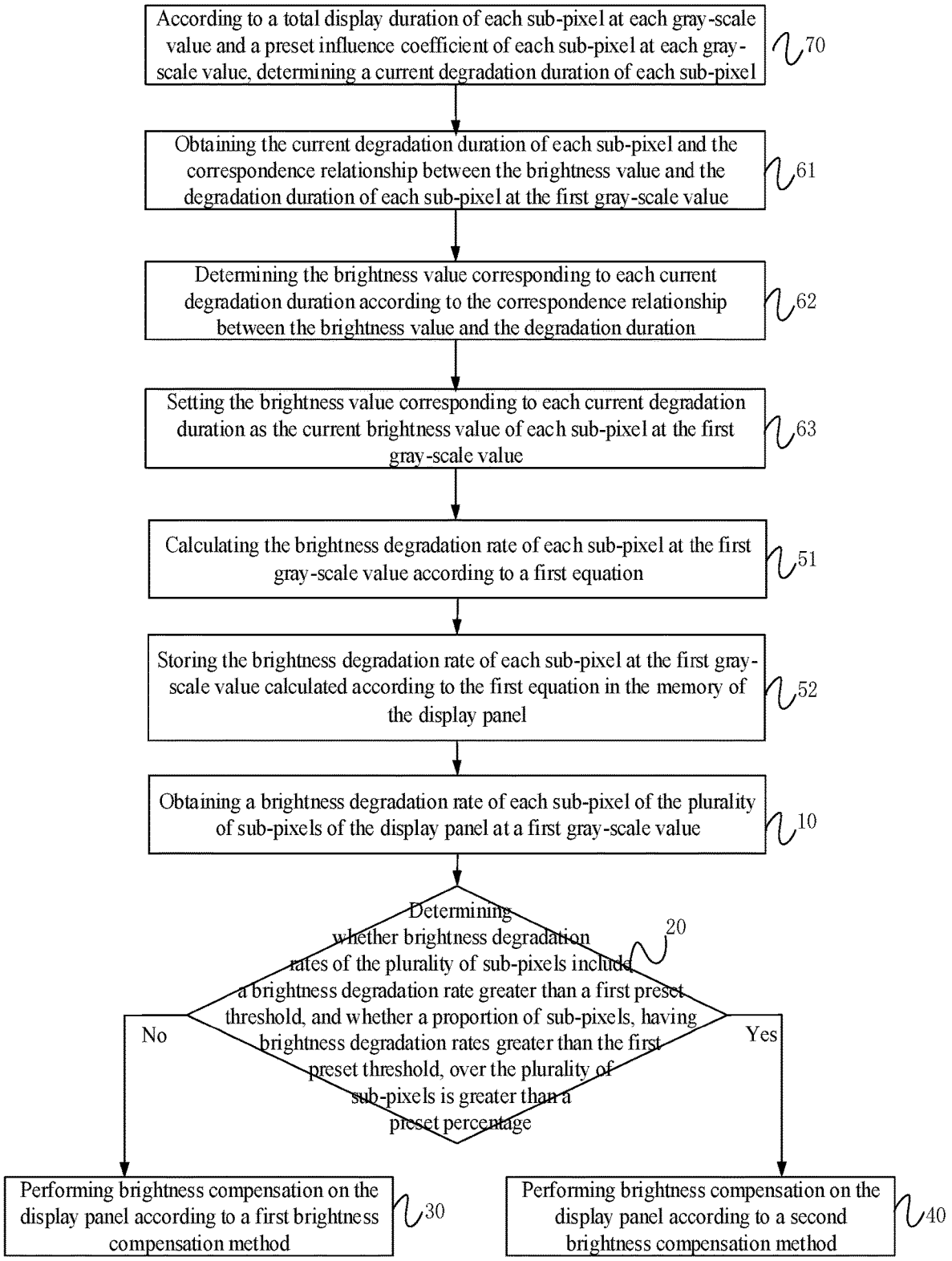
FIG. 5 illustrates a schematic flowchart of another exemplary method for brightness compensation of a display panel consistent with disclosed embodiments of the present disclosure.

FIG. 5 illustrates a schematic flowchart of another method for brightness compensation of a display panel consistent with disclosed embodiments of the present disclosure. The steps in FIG. 5 that are the same as the steps in FIG. 3 may be marked with the same signs. Referring to FIG. 5, before performing step 61, the method for brightness compensation of the display panel provided by the disclosed embodiments associated with FIG. 5 may further include a step 70.

In step 70: according to a total display duration of each sub-pixel at each gray-scale value and a preset influence coefficient of each sub-pixel at each gray-scale value, determining the current degradation duration of each sub-pixel.

In actual display process of the display panel, a same sub-pixel may not always display an image with one gray-scale value. The aging rate of each sub-pixel at different gray-scale value may be different. If the image with different gray-scale value displayed by the sub-pixels is not considered, and the total display duration of the sub-pixel is simply used as the current display duration of the sub-pixel, the issue that the aging rate of the sub-pixel at different gray-scale value is different may not be taken into account. The total display duration of the sub-pixel may be understood as the total display duration of the display panel from the factory to the current moment. In the present disclosure, the issue that the aging rate of the sub-pixel at different gray-scale value is different may be taken into account, to achieve substantially effective brightness compensation for the display panel.

The total display duration of the sub-pixel at each gray-scale value may be understood as the total display duration of the sub-pixel at each gray-scale value of the display panel from the factory to the current moment. In one embodiment, a refresh frequency of the display panel may often be fixed, and the total display duration of the sub-pixel at each gray-scale value may be counted with a frame as a timing unit. In another embodiment, the unit of the total display duration of the sub-pixel at each gray-scale value may be hour.

Specifically, a sum of the products of the total display duration of the sub-pixel at various gray-scale values and the corresponding preset influence coefficients at various gray-scale values may be used as the current degradation duration of each sub-pixel.

For example, from the factory to the current moment, a sub-pixel of the display panel may display three images with different gray-scale values, namely an image with a gray-scale value of 60, an image with a gray-scale value of 120, and an image with a gray-scale value of 224. In one embodiment, the total display durations at various gray-scale values may be $t_{60}$, $t_{120}$, and $t_{224}$, respectively, and the preset influence coefficients at various gray-scale values may be f(60), f(120), and f(224), respectively. Then, the current degradation duration of the sub-pixel may be $t_{60}*f(60)+t_{120}*f(120)+t_{224}*f(224)$.

In addition, an aging test may be performed on the sample display panel in advance to determine the preset influence coefficient of each sub-pixel at each gray-scale value. For example, an image with a different gray-scale value may be inputted to each sub-pixel of the sample display panel, and the aging rate of each sub-pixel at the image with different gray-scale value may be measured. According to the aging rate of each sub-pixel at the image with different gray-scale value, the influence coefficient of each sub-pixel at each gray-scale value may be set. Therefore, before performing the step 70, the determined preset influence coefficient of each sub-pixel at each gray-scale value may be stored in the memory of the display panel, and may be directly obtained and used in the brightness compensation process.

In certain embodiments, step 70 may specifically include: after each display completion of the display panel, or after a ratio of a current brightness value of the sub-pixel at a current moment over a current brightness value of the sub-pixel at a beginning of each display is less than a second preset threshold, according to the total display duration of each sub-pixel at each gray-scale value and the preset influence coefficient of each sub-pixel at each gray-scale value, determining a current degradation duration of each sub-pixel; and updating the determined current degradation duration of each sub-pixel in the memory of the display panel.

In a short duration, the sub-pixel may not be obviously aged. In one embodiment, the current degradation duration of each sub-pixel may be counted in real time. In another embodiment, after each display completion of the display panel, or after a ratio of a current brightness value of the sub-pixel at a current moment over a current brightness value of the sub-pixel at a beginning of each display is less than a second preset threshold, the current degradation duration of each sub-pixel may be updated into the memory of the display panel. Therefore, while ensuring the accuracy of the current degradation duration of each sub-pixel used in the brightness compensation process, the waste of storage resource caused by real-time storage may be avoided.

In one embodiment, a current brightness value of the sub-pixel at the current moment and a current brightness value of the sub-pixel at the beginning of the display may be determined according to the foregoing steps 61-63. The second preset threshold may be configured according to actual needs, or may be configured according to experience. For example, the second preset threshold may be 99%, etc. For example, the display panel may be used for a long time. The display panel may start to display at 7 μm, a current brightness value of the sub-pixel at 7 μm may be 410 nit, and a corresponding current brightness value at 9 μm may be 400 nit. Because 400/410 is less than 99%, the current degradation duration corresponding to 9 μm may be updated into the memory of the display panel. Therefore, the issue that the display panel is used for a long time, and the display panel cannot be timely and effectively compensated may be prevented.

Further, after the current degradation duration of each sub-pixel is updated into the memory of the display panel, correspondingly, in step 52, according to the updated current degradation duration of each sub-pixel, the brightness degradation rate of each sub-pixel at the first gray-scale value may be determined, and may be updated into the memory of the display panel.

In one embodiments, performing brightness compensation on the display panel according to the first brightness compensation method may include performing brightness compensation on the to-be-compensated sub-pixel in the display panel in a compensation method of increasing brightness. In another embodiment, performing brightness compensation on the display panel according to the first brightness compensation method may include performing brightness compensation on a portion of the sub-pixels in the display panel in a compensation method of increasing brightness, and performing brightness compensation on a portion of the sub-pixels in the display panel in a compensation method of decreasing brightness. Details may refer to descriptions associated with FIG. 6 and FIG. 8.

Figure 6:
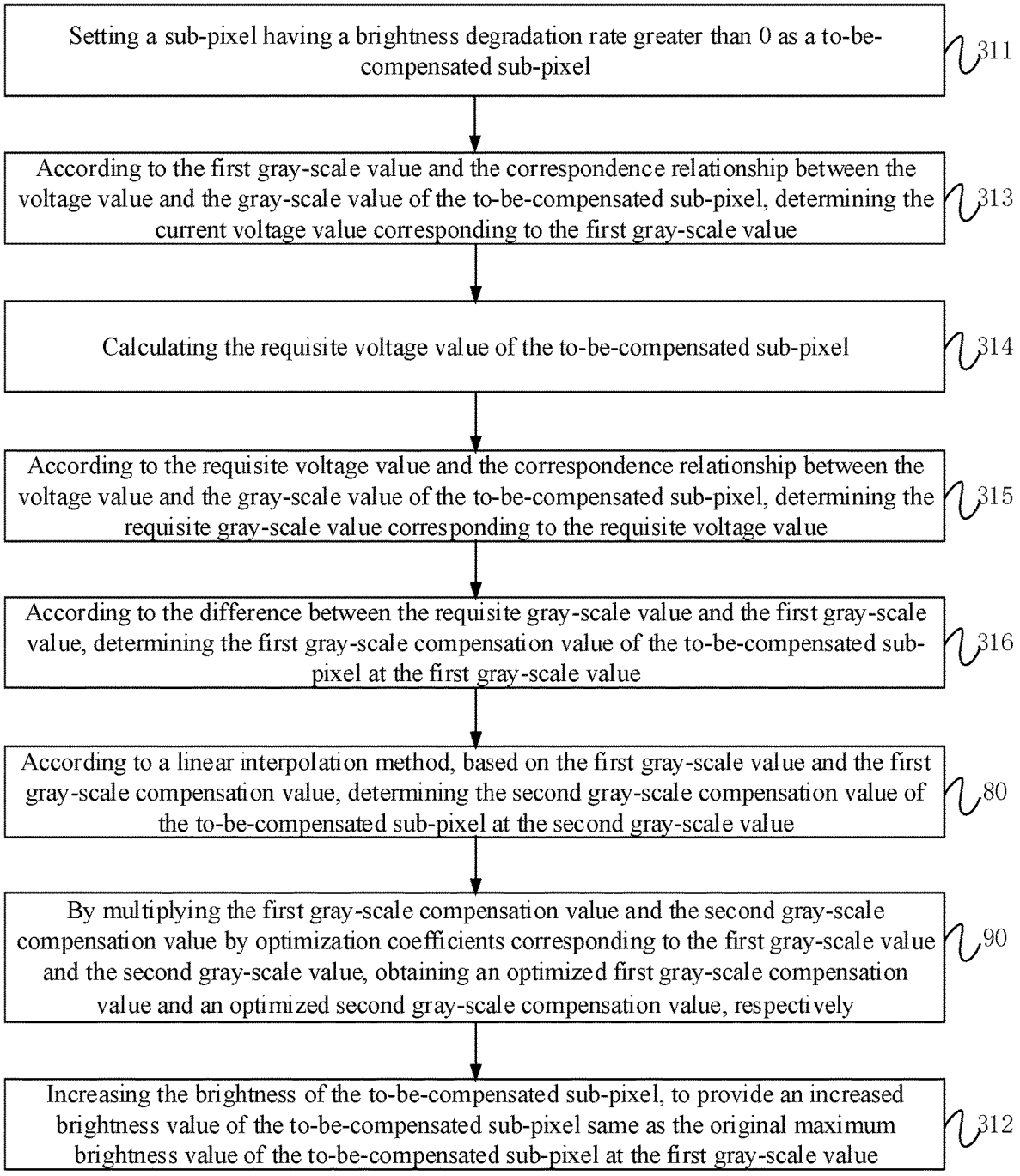
FIG. 6 illustrates a schematic flowchart of an exemplary method of performing brightness compensation on a display panel according to a first brightness compensation method consistent with disclosed embodiments of the present disclosure.

FIG. 6 illustrates a schematic flowchart of a method of performing brightness compensation on a display panel according to a first brightness compensation method consistent with disclosed embodiments of the present disclosure. Referring to FIG. 6, step 30 may specifically include step 311 and step 312.

In step 311: setting a sub-pixel having a brightness degradation rate greater than 0 as a to-be-compensated sub-pixel.

In step 312: increasing the brightness of the to-be-compensated sub-pixel, to provide an increased brightness value of the to-be-compensated sub-pixel same as the original maximum brightness value of the to-be-compensated sub-pixel at the first gray-scale value.

The sub-pixel with a brightness degradation rate of 0 may not be aged, and the sub-pixel with a brightness degradation rate greater than 0 may be aged. Merely the brightness of the sub-pixel that has been aged may be compensated, which may avoid unnecessary calculations.

Referring to FIG. 6, before performing step 312, the method for brightness compensation of the display panel provided by the disclosed embodiments of the present disclosure may further include steps 313-316.

In step 313: according to the first gray-scale value and the correspondence relationship between the voltage value and the gray-scale value of the to-be-compensated sub-pixel, determining the current voltage value corresponding to the first gray-scale value.

In one embodiment, Gamma debugging may be performed on the display panel to determine the correspondence relationship between the voltage value and the gray-scale value of each sub-pixel of the display panel, and the determined correspondence relationship between the voltage value and the gray-scale value of each sub-pixel may be stored in the memory of the display panel.

In step 314: calculating the requisite voltage value of the to-be-compensated sub-pixel according to the relationship (2):

$$V_2 = V_1 \times (1 + \text{Dege}') \quad (2),$$

where $V_2$ is the requisite voltage value, $V_1$ is the current voltage value, and Dege' is the brightness degradation rate of the to-be-compensated sub-pixel.

Figure 7:
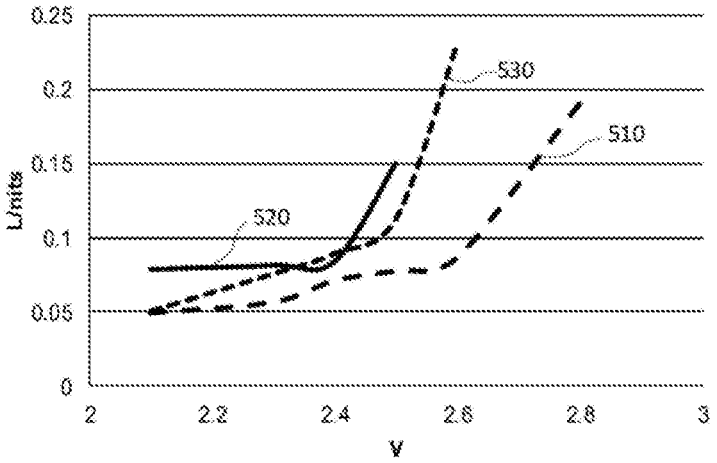
FIG. 7 illustrates a schematic diagram of a correspondence relationship between a voltage value and brightness value of a sub-pixel consistent with disclosed embodiments of the present disclosure.

FIG. 7 illustrates a schematic diagram of the correspondence relationship between the voltage value and the brightness of the sub-pixel consistent with disclosed embodiments of the present disclosure. In FIG. 7, the abscissa represents the voltage value provided to the sub-pixel, and the ordinate represents the brightness. A curve 510 may be a relationship curve between the voltage value and the brightness of the red sub-pixel, a curve 520 may be a relationship curve between the voltage value and the brightness of the green sub-pixel, and a curve 530 may be a relationship curve between the voltage value and the brightness of the blue sub-pixel. Referring to FIG. 7, the voltage value provided to the sub-pixel may have a linear relationship with the brightness of the sub-pixel. In other words, the greater the voltage value provided to the sub-pixel, the greater the brightness of the sub-pixel; and the smaller the voltage value provided to the sub-pixel, the smaller the brightness of the sub-pixel. The brightness of the sub-pixel may increase by increasing the voltage value provided to the sub-pixel. Similarly, the brightness of the sub-pixel may decrease by reducing the voltage value provided to the sub-pixel.

For illustrative purposes, Dege' of 5% may be used as an example. In other words, the brightness of the to-be-compensated sub-pixel may be degraded by 5%. Because the voltage value provided to the sub-pixel has a linear relationship with the brightness of the sub-pixel, the current voltage value of the to-be-compensated sub-pixel may increase by 5% to increase the brightness of the to-be-compensated sub-pixel, In step 315: according to the requisite voltage value and the correspondence relationship between the voltage value and the gray-scale value of the to-be-compensated sub-pixel, determining the requisite gray-scale value corresponding to the requisite voltage value.

The first gray-scale compensation value of the to-be-compensated sub-pixel at the first gray-scale value may be estimated according to the first preset threshold. For illustrative purposes, the first gray-scale value of 255 and the first preset threshold value of 10% may be used as an example. The first gray-scale compensation value of a to-be-compensated sub-pixel at the first gray-scale value may be approximately 25, and, thus, not only the voltage values corresponding to the gray-scale values of 0-255 may be stored, but also the voltage values corresponding to the gray-scale values of 256-275 may be stored. Therefore, the requisite gray-scale value corresponding to the requisite voltage value may be found in the correspondence relationship between the voltage value and the gray-scale value of the to-be-compensated sub-pixel.

In step 316: according to the difference between the requisite gray-scale value and the first gray-scale value, determining the first gray-scale compensation value of the to-be-compensated sub-pixel at the first gray-scale value.

The first gray-scale compensation value in step 316 may be a positive number. After determining the first gray-scale compensation value, the brightness of the to-be-compensated sub-pixel may increase based on the first gray-scale compensation value.

In the disclosed embodiments of the present disclosure, based on the principle that the voltage value of the sub-pixel has a linear relationship with the brightness of the sub-pixel, the first gray-scale compensation value may be accurately obtained, thereby improving the effectiveness of the brightness compensation.

Figure 8:
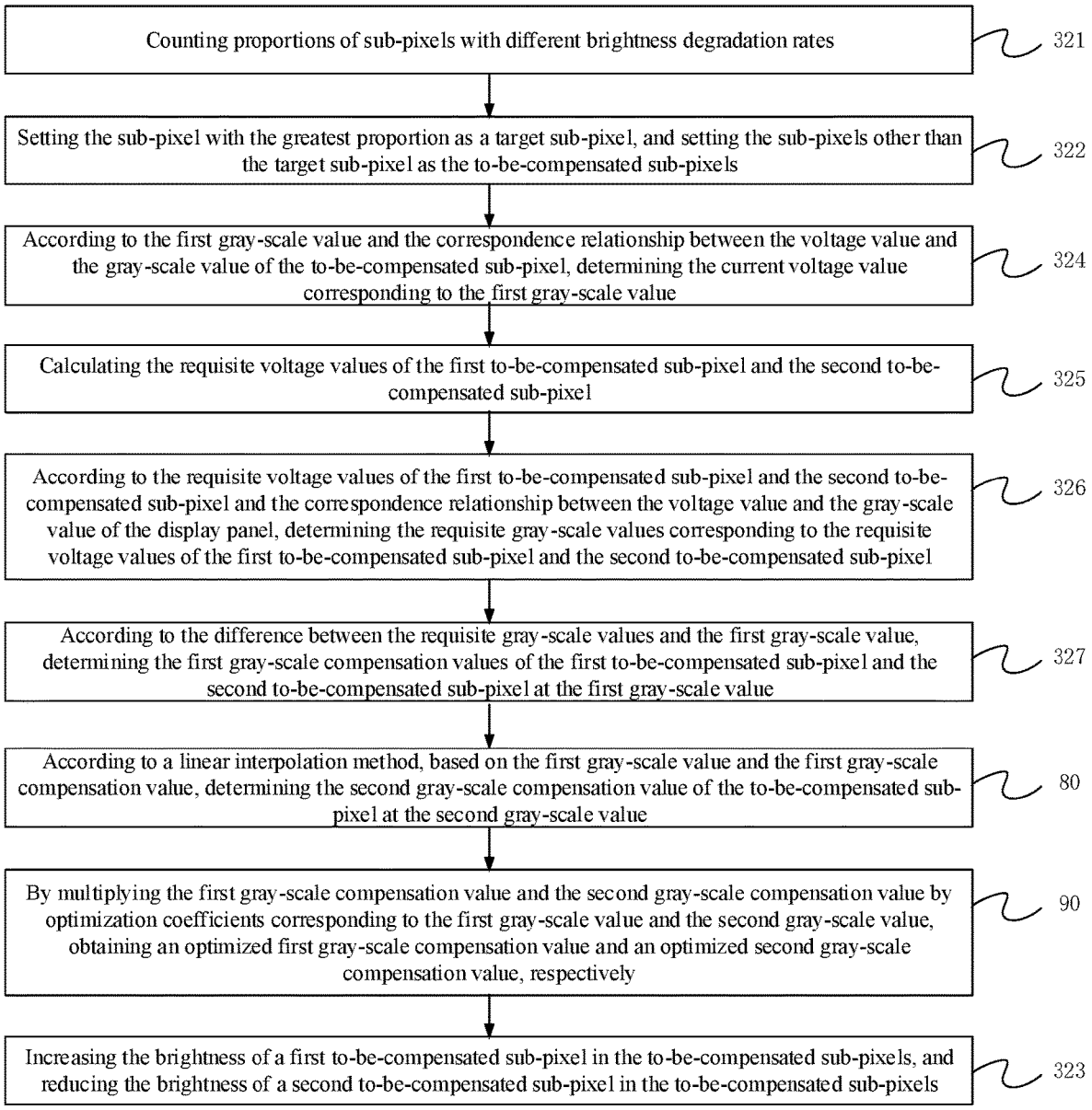
FIG. 8 illustrates a schematic flowchart of another exemplary method of performing brightness compensation on a display panel according to a first brightness compensation method consistent with disclosed embodiments of the present disclosure.

FIG. 8 illustrates a schematic flowchart of another method of performing brightness compensation on a display panel according to a first brightness compensation method consistent with disclosed embodiments of the present disclosure. Referring to FIG. 8, step 30 may specifically include steps 321-323.

In step 321: counting proportions of sub-pixels with different brightness degradation rates.

In step 322: setting the sub-pixel with the greatest proportion as a target sub-pixel, and setting the sub-pixels other than the target sub-pixel as the to-be-compensated sub-pixels.

In step 323: increasing the brightness of a first to-be-compensated sub-pixel in the to-be-compensated sub-pixels, and reducing the brightness of a second to-be-compensated sub-pixel in the to-be-compensated sub-pixels, such that the increased brightness of the first to-be-compensated sub-pixel and the reduced brightness of the second to-be-compensated sub-pixel may be the same as the brightness of the target sub-pixel.

The brightness degradation rate of the first to-be-compensated sub-pixel may be greater than the brightness degradation rate of the target sub-pixel, and the brightness degradation rate of the second to-be-compensated sub-pixel may be less than the brightness degradation rate of the target sub-pixel.

For example, in a case where the determination result of step 20 is no, the brightness degradation rates may include three values, namely 5%, 8%, and 10%. A proportion of the sub-pixels with brightness degradation rate of 5% may be 30%, a proportion of the sub-pixels with brightness degradation rate of 10% may be 30%, and a proportion of the sub-pixels with brightness degradation rate of 8% may be 40%. The sub-pixel with the brightness degradation rate of 8% may be configured as the target sub-pixel, and the sub-pixels with brightness degradation rates of 5% and 10% may be configured as the to-be-compensated sub-pixels. The sub-pixel with the brightness degradation rate of 10% may be configured as the first to-be-compensated sub-pixel, and the sub-pixel with the brightness degradation rate of 5% may be configured as the second to-be-compensated sub-pixel.

In the disclosed embodiments of the present disclosure, while improving the brightness uniformity of the display panel, the quantity of sub-pixels that need to be compensated may be reduced, and the power consumption of the display panel may be prevented from increasing too much.

Referring to FIG. 8, before performing the step 323, the method for brightness compensation of the display panel provided by the disclosed embodiments of the present disclosure may further include steps 324-327.

In step 324: according to the first gray-scale value and the correspondence relationship between the voltage value and the gray-scale value of the to-be-compensated sub-pixel, determining the current voltage value corresponding to the first gray-scale value.

In step 325: calculating the requisite voltage values of the first to-be-compensated sub-pixel and the second to-be-compensated sub-pixel according to the relationships (3) and (4):

$$V_3=V_1\times(1+\mathrm{Dege}_1-\mathrm{Dege}_o) \tag{3}$$

$$V_4=V_1\times(1+\mathrm{Dege}_2-\mathrm{Dege}_o) \tag{4}$$

where $V_3$ is the requisite voltage value of the first to-be-compensated sub-pixel, $V_1$ is the current voltage value, $\mathrm{Dege}_o$ is the brightness degradation rate of the target sub-pixel, $\mathrm{Dege}_1$ is the brightness degradation rate of the first to-be-compensated sub-pixel, $V_4$ is the requisite voltage value of the second to-be-compensated sub-pixel, and $\mathrm{Dege}_2$ is the brightness degradation rate of the second to-be-compensated sub-pixel.

For illustrative purposes, $\mathrm{Dege}_o$ of 8%, $\mathrm{Dege}_1$ of 10%, and $\mathrm{Dege}_2$ of 5% may be used as an example. The voltage value of the sub-pixel may have a linear relationship with the brightness of the sub-pixel. The brightness degradation rate of the first to-be-compensated sub-pixel may be greater than the brightness degradation rate of the target sub-pixel, and, thus, the voltage value of the first to-be-compensated sub-pixel may need to be increased, and the increased range may be 10%-8%, that is 2%. Similarly, the brightness degradation rate of the second to-be-compensated sub-pixel may be less than the brightness degradation rate of the target sub-pixel, and, thus, the voltage value of the second to-be-compensated sub-pixel may need to be reduced, and the reduced range may be 8%-5%, that is 3%.

In step 326: according to the requisite voltage values of the first to-be-compensated sub-pixel and the second to-be-compensated sub-pixel and the correspondence relationship between the voltage value and the gray-scale value of the display panel, determining the requisite gray-scale values corresponding to the requisite voltage values of the first to-be-compensated sub-pixel and the second to-be-compensated sub-pixel.

In step 327: according to the difference between the requisite gray-scale values and the first gray-scale value, determining the first gray-scale compensation values of the first to-be-compensated sub-pixel and the second to-be-compensated sub-pixel at the first gray-scale value.

In the disclosed embodiments of the present disclosure, based on the principle that the voltage value of the sub-pixel has a linear relationship with the brightness of the sub-pixel, the first gray-scale compensation values may be accurately obtained, thereby improving the effectiveness of the brightness compensation.

Figure 9:
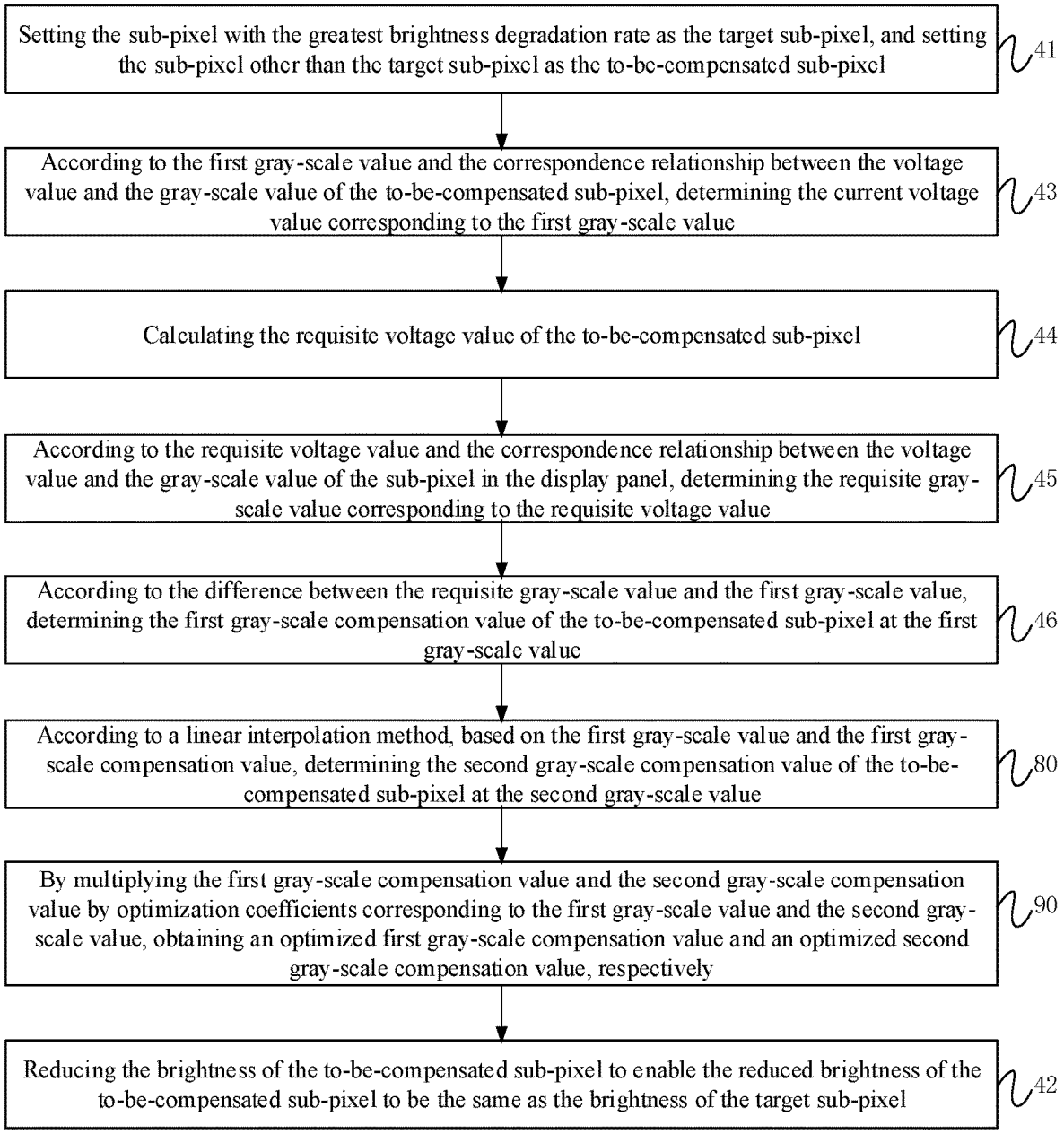
FIG. 9 illustrates a schematic flowchart of an exemplary method of performing brightness compensation on a display panel according to a second brightness compensation method consistent with disclosed embodiments of the present disclosure.

FIG. 9 illustrates a schematic flowchart of a method of performing brightness compensation on a display panel according to a second brightness compensation method consistent with disclosed embodiments of the present disclosure. Referring to FIG. 9, step 40 may specifically include step 41 and step 42.

In step 41: setting the sub-pixel with the greatest brightness degradation rate as the target sub-pixel, and setting the sub-pixel other than the target sub-pixel as the to-be-compensated sub-pixel.

In step 42: reducing the brightness of the to-be-compensated sub-pixel, such that the reduced brightness of the to-be-compensated sub-pixel may be the same as the brightness of the target sub-pixel.

For example, in a case where the determination result of step 20 is yes, the brightness degradation rates may include three values, namely 5%, 8%, and 10%. The sub-pixel with the brightness degradation rate of 10% may be configured as the target sub-pixel, and the sub-pixels with brightness degradation rates of 5% and 8% may be configured as the to-be-compensated sub-pixels. The brightness degradation rate of the target sub-pixel may be the greatest, in other words, the aging degree of the target sub-pixel may be the most serious. Therefore, at a same gray-scale value, the brightness of the target sub-pixel may be the smallest. As mentioned above, the voltage value provided to the sub-pixel may have a linear relationship with the brightness of the sub-pixel, and the brightness of the sub-pixel may be reduced by reducing the voltage provided to the sub-pixel. Therefore, it may be ensured that while improving the brightness uniformity of the display panel, the power consumption of the display panel may be prevented from being too large.

Referring to FIG. 9, before performing step 42, the method for brightness compensation of the display panel provided by the disclosed embodiments of the present disclosure may further include steps 43-46.

In step 43: according to the first gray-scale value and the correspondence relationship between the voltage value and the gray-scale value of the to-be-compensated sub-pixel, determining the current voltage value corresponding to the first gray-scale value.

In step 44: calculating the requisite voltage value of the to-be-compensated sub-pixel according to the relationship (5):

$$V_5=V_1\times(1+\mathrm{Dege}_3-\mathrm{Dege}_o) \quad (5),$$

where $V_5$ is the requisite voltage value of the to-be-compensated sub-pixel, $V_1$ is the current voltage value, $\mathrm{Dege}_o$ is the brightness degradation rate of the target sub-pixel, and $\mathrm{Dege}_3$ is the brightness degradation rate of the to-be-compensated sub-pixel.

In step 45: according to the requisite voltage value and the correspondence relationship between the voltage value and the gray-scale value of the sub-pixel in the display panel, determining the requisite gray-scale value corresponding to the requisite voltage value.

In step 46: according to the difference between the requisite gray-scale value and the first gray-scale value, determining the first gray-scale compensation value of the to-be-compensated sub-pixel at the first gray-scale value.

In the disclosed embodiments of the present disclosure, based on the principle that the voltage value of the sub-pixel has a linear relationship with the brightness of the sub-pixel, the first gray-scale compensation value may be accurately obtained, thereby improving the effectiveness of the brightness compensation.

Figure 10:
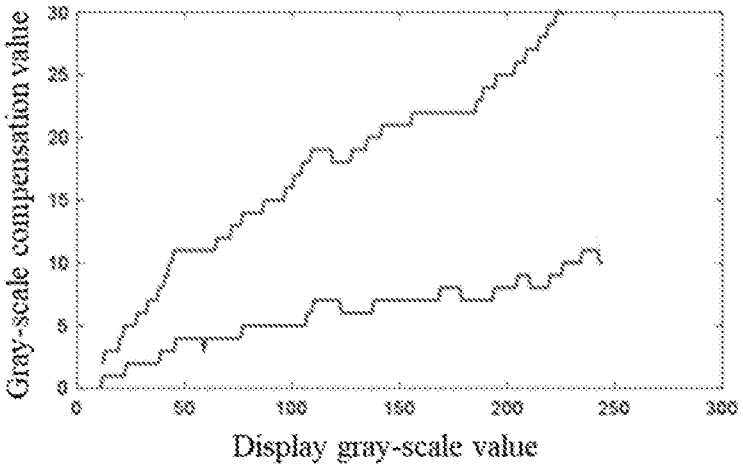
FIG. 10 illustrates a schematic diagram of requisite gray-scale compensation values of an exemplary sub-pixel at various gray-scale values consistent with disclosed embodiments of the present disclosure.

FIG. 10 illustrates a schematic diagram of requisite gray-scale compensation values of a sub-pixel at various gray-scale values consistent with disclosed embodiments of the present disclosure. In FIG. 10, the abscissa represents the display gray-scale value of the sub-pixel, and the ordinate represents the requisite gray-scale compensation value of the sub-pixel. The two curves may correspond to the sub-pixels of two colors, respectively. The requisite gray-scale compensation value of the same sub-pixel may have a linear relationship with the gray-scale value. Therefore, referring to any one of the drawings in FIG. 6, FIG. 8 and FIG. 9, the method for brightness compensation of the display panel provided by the disclosed embodiments of the present disclosure may further include step 80.

In step 80: according to a linear interpolation method, based on the first gray-scale value and the first gray-scale compensation value, determining the second gray-scale compensation value of the to-be-compensated sub-pixel at the second gray-scale value.

In one embodiment, the first gray-scale value may be 255, the first gray-scale compensation value calculated according to the above steps may be 10, and the second gray-scale value may be X, then the second gray-scale compensation value may be (X/255)*10. For example, if the second gray-scale value is 100, the second gray-scale compensation value may be (100/255)*10≈3.9. The gray-scale compensation value may often be an integer, and, thus, when the second gray-scale value is 100, correspondingly, the second gray-scale compensation value may be rounded to a nearest whole number of 4.

According to the disclosed embodiments of the present disclosure, the second gray-scale compensation value of the to-be-compensated sub-pixel at the second gray-scale value may be calculated according to the linear interpolation method, which may reduce the amount of calculation and save calculation resources.

Figure 11:
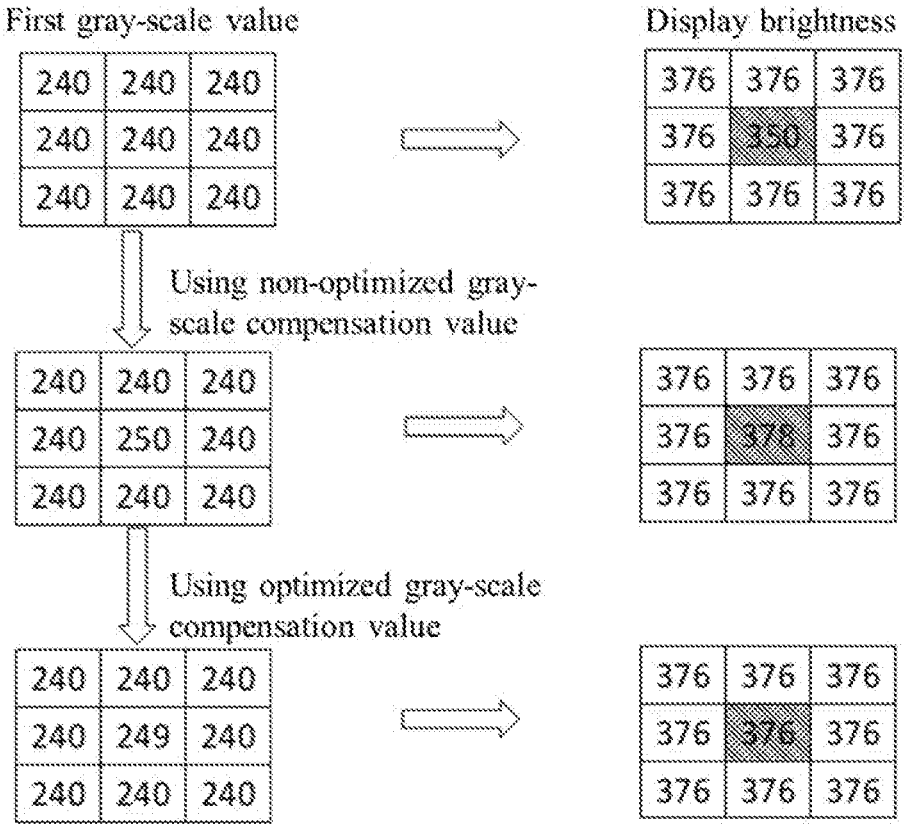
FIG. 11 illustrates a schematic diagram of a compensation effect consistent with disclosed embodiments of the present disclosure.

FIG. 11 illustrates a schematic diagram of a compensation effect consistent with disclosed embodiments of the present disclosure. FIG. 11 may be a group of experimental data. For illustrative purposes, FIG. 11 illustrates sub-pixels with three rows and three columns, and the first gray-scale value may be 240 as an example. The display brightness of the sub-pixel in the second row and second column at the gray-scale value of 240 may be 350 nit, and the display brightness of any other sub-pixel at the gray-scale value of 240 may be 376 nit. Assuming that merely the sub-pixel in the second row and second column is aged, in other words, the sub-pixel in the second row and second column is the to-be-compensated sub-pixel, the brightness of the sub-pixel in the second row and second column may need to increase to 376 nit. According to the method of calculating the first gray-scale compensation value, the first gray-scale compensation value of the sub-pixel in the second row and second column at the gray-scale value of 240 may be 10. After performing the brightness compensation on the sub-pixel in the second row and second column, the display brightness of the sub-pixel in the second row and second column may be 378 nit. In other words, if the brightness compensation is performed on the to-be-compensated sub-pixel by directly using the first gray-scale compensation value, a phenomenon of over-compensation may occur.

Therefore, referring to any one of the drawings in FIG. 6, FIG. 8 and FIG. 9, the method for brightness compensation of the display panel provided by the disclosed embodiments of the present disclosure may further include step 90.

In step 90: by multiplying the first gray-scale compensation value and the second gray-scale compensation value by optimization coefficients corresponding to the first gray-scale value and the second gray-scale value, obtaining an optimized first gray-scale compensation value and an optimized second gray-scale compensation value, respectively.

Assuming that the optimization coefficient (Gain) corresponding to the first gray-scale value of 240 is 0.9, the first gray-scale compensation value of 10 may be multiplied by the optimization coefficient of 0.9 to obtain the optimized first gray-scale compensation value of 9. Referring to FIG. 11, after performing the brightness compensation on the sub-pixel in the second row and second column based on the optimized first gray-scale compensation value of 9, the display brightness of the sub-pixel may be 376 nit, thereby avoiding the phenomenon of over-compensation.

In one embodiment, the optimization coefficient corresponding to each gray-scale value may be pre-stored in the memory of the display panel. The optimization coefficient corresponding to different gray-scale value may be different. The optimization coefficient of the sub-pixel of a same color at the same gray-scale value may be the same.

Figure 12:
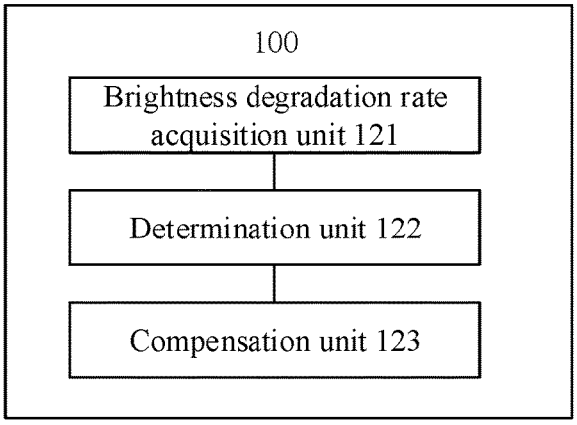
FIG. 12 illustrates a schematic structural diagram of an exemplary device for brightness compensation of a display panel consistent with disclosed embodiments of the present disclosure.

FIG. 12 illustrates a schematic structural diagram of a device for brightness compensation of a display panel consistent with disclosed embodiments of the present disclosure. A device 100 for brightness compensation of the display panel may include a brightness degradation rate acquisition unit 121, a determination unit 122 and a compensation unit 123.

The brightness degradation rate acquisition unit 121 may be configured to obtain the brightness degradation rate of each sub-pixel of a plurality of sub-pixels of the display panel at the first gray-scale value. The brightness degradation rate may be a ratio of an attenuated brightness value over an original maximum brightness of the sub-pixel at the first gray-scale value. The original maximum brightness value may be the initial brightness of the sub-pixel at the first gray-scale value, and the attenuated brightness value may be the difference between the original maximum brightness value and the current brightness value of the sub-pixel at the first gray-scale value.

The determination unit 122 may be configured to determine whether brightness degradation rates of the plurality of sub-pixels include a brightness degradation rate greater than a first preset threshold, and whether a proportion of sub-pixels, having brightness degradation rates greater than the first preset threshold, over the plurality of sub-pixels is greater than a preset percentage.

If the determination result of the determination unit 122 is no, the compensation unit 123 may be configured to perform brightness compensation on the display panel according to a first brightness compensation method. If the determination result of the determination unit 122 is yes, the compensation unit 123 may be configured to perform brightness compensation on the display panel according to a second brightness compensation method. The first brightness compensation method may include increasing the brightness of at least a portion of the sub-pixels in the display panel, and the second brightness compensation method may include reducing the brightness of at least a portion of the sub-pixels in the display panel.

In the device for brightness compensation of the display panel provided by the present disclosure, by obtaining the brightness degradation rate of each sub-pixel of the display panel at the first gray-scale value, the brightness degradation condition of each sub-pixel of the display panel may be determined. In view of different brightness degradation condition, the brightness compensation may be performed on the display panel according to a different brightness compensation method. While improving the brightness uniformity of the display panel, the brightness of the display panel may be compensated in a targeted manner to achieve a desired compensation effect.

Figure 13:
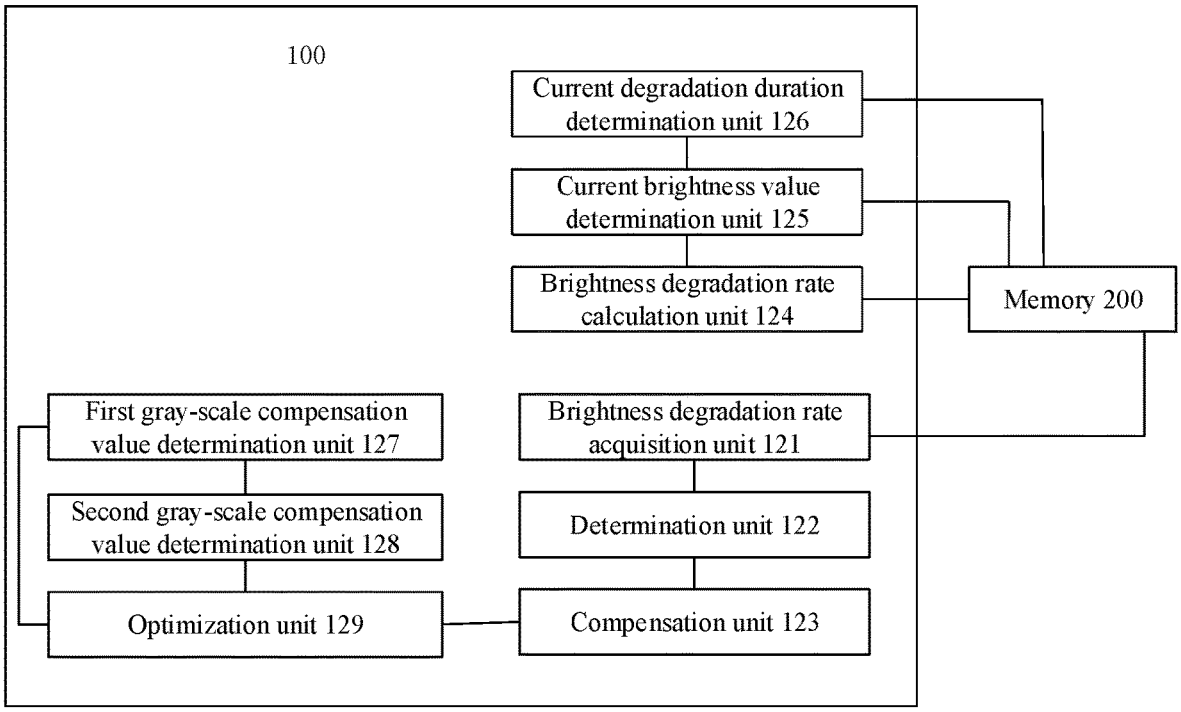
FIG. 13 illustrates a schematic structural diagram of another exemplary device for brightness compensation of a display panel consistent with disclosed embodiments of the present disclosure.

FIG. 13 illustrates a schematic structural diagram of another device for brightness compensation of a display panel consistent with disclosed embodiments of the present disclosure. In certain embodiments, the display panel may include a memory 200. Referring to FIG. 13, the device 100 for brightness compensation of the display panel may further include a brightness degradation rate calculation unit 124.

The brightness degradation rate calculation unit 124 may be configured to calculate the brightness degradation rate of each sub-pixel at the first gray-scale value according to the above-mentioned relationship (1). The brightness degradation rate of each sub-pixel at the first gray-scale value obtained by calculating according to the above-mentioned relationship (1) may be stored in the memory 200 of the display panel.

Referring to FIG. 13, in certain embodiments, the device 100 for brightness compensation of the display panel may further include a current brightness value determination unit 125.

The current brightness value determination unit 125 may be configured to: obtain a current degradation duration of each sub-pixel, and obtain the correspondence relationship between the brightness value and the degradation duration of each sub-pixel at the first gray-scale value; according to the correspondence relationship between the brightness value and the degradation duration, determine a brightness value corresponding to the current degradation duration; and set the brightness value corresponding to the current degradation duration as the current brightness value of each sub-pixel at the first gray-scale value.

Referring to FIG. 13, in certain embodiments, the device 100 for brightness compensation of the display panel may further include a current degradation duration determination unit 126.

The current degradation duration determination unit 126 may be configured to determine the current degradation duration of each sub-pixel according to a total display duration of each sub-pixel at each gray-scale value and the preset influence coefficient of each sub-pixel at each gray-scale value.

In certain embodiments, the current degradation duration determination unit 126 may be specifically configured to: after each display completion of the display panel, or after a ratio of a current brightness value of the sub-pixel at a current moment over a current brightness value of the sub-pixel at a beginning of each display is less than a second preset threshold, according to the total display duration of each sub-pixel at each gray-scale value and the preset influence coefficient of each sub-pixel at each gray-scale value, determine the current degradation duration of each sub-pixel; and update the determined current degradation duration of each sub-pixel into the memory of the display panel.

In certain embodiments, the compensation unit 123 may be specifically configured to: set a sub-pixel with a brightness degradation rate greater than 0 as a to-be-compensated sub-pixel; increase the brightness of the to-be-compensated sub-pixel, such that the increased brightness value of the to-be-compensated sub-pixel may be the same as the original maximum brightness value of the to-be-compensated sub-pixel at the first gray-scale value.

Referring to FIG. 13, in certain embodiments, the device 100 for brightness compensation of the display panel may further include a first gray-scale compensation value determination unit 127.

The first gray-scale compensation value determination unit 127 may be configured to determine the current voltage value corresponding to the first gray-scale value according to the first gray-scale value and the correspondence relationship between the voltage value and the gray-scale value of the to-be-compensated sub-pixel; calculate the requisite voltage value of the to-be-compensated sub-pixel according to the above relationship (2); according to the requisite voltage value and the correspondence relationship between the voltage value and the gray-scale value of the to-be-compensated sub-pixel, determine the requisite gray-scale value corresponding to the requisite voltage value; and according to the difference between the requisite gray-scale value and the first gray-scale value, determine the first gray-scale compensation value of the to-be-compensated sub-pixel at the first gray-scale value.

In certain embodiments, the compensation unit 123 may be specifically configured to: count proportions of sub-pixels with different brightness degradation rates; set the sub-pixel with the greatest proportion as the target sub-pixel, and set the sub-pixels other than the target sub-pixel as the to-be-compensated sub-pixels; increase the brightness of the first to-be-compensated sub-pixel in the to-be-compensated sub-pixels and reduce the brightness of the second to-be-compensated sub-pixel in the to-be-compensated sub-pixels, such that the increased brightness of the first to-be-compensated sub-pixel and the reduced brightness of the second to-be-compensated sub-pixel may be the same as the brightness of the target sub-pixel. The brightness degradation rate of the first to-be-compensated sub-pixel may be greater than the brightness degradation rate of the target sub-pixel, and the brightness degradation rate of the second to-be-compensated sub-pixel may be less than the brightness degradation rate of the target sub-pixel.

In certain embodiments, the first gray-scale compensation value determination unit 127 may be configured to: according to the first gray-scale value and the correspondence relationship between the voltage value and the gray-scale value of the to-be-compensated sub-pixel, determine the current voltage value corresponding to the first gray-scale value; according to the above relationships (3) and (4), calculate the requisite voltage values of the first to-be-compensated sub-pixel and the second to-be-compensated sub-pixel, respectively; according to the requisite voltage values of the first to-be-compensated sub-pixel and the second to-be-compensated sub-pixel and the correspondence relationship between the voltage value and the gray-scale value of the sub-pixel of the display panel, determine the requisite gray-scale values corresponding to the requisite voltage values of the first to-be-compensated sub-pixel and the second to-be-compensated sub-pixel; and according to the difference between the corresponding requisite voltage values and the first gray-scale value, determine the first gray-scale compensation values of the first to-be-compensated sub-pixel and the second to-be-compensated sub-pixel at the first gray-scale value, respectively.

In certain embodiments, the compensation unit 123 may be specifically configured to: set the sub-pixel with the greatest brightness degradation rate as the target sub-pixel, and set the sub-pixel other than the target sub-pixel as the to-be-compensated sub-pixel; and reduce the brightness of the to-be-compensated sub-pixel to enable the reduced brightness of the to-be-compensated sub-pixel to be the same as the brightness of the target sub-pixel.

In certain embodiments, the first gray-scale compensation value determination unit 127 may be configured to: according to the first gray-scale value and the correspondence relationship between the voltage value and the gray-scale value of the to-be-compensated sub-pixel, determine the current voltage value corresponding to the first gray-scale value; calculate the requisite voltage value of the to-be-compensated sub-pixel according to the above relationship (5); according to the requisite voltage value and the correspondence relationship between the voltage value and the gray-scale value of the sub-pixel of the display panel, determine the requisite gray-scale value corresponding to the requisite voltage value; and according to the difference between the requisite gray-scale value and the first gray-scale value, determine the first gray-scale compensation value of the to-be-compensated sub-pixel at the first gray-scale value.

Referring to FIG. 13, in certain embodiments, the device 100 for brightness compensation of the display panel may further include a second gray-scale compensation value determination unit 128.

The second gray-scale compensation value determination unit 128 may be configured to according to a linear interpolation method, determine the second gray-scale compensation value of the to-be-compensated sub-pixel at the second gray-scale value based on the first gray-scale value and the first gray-scale compensation value.

Referring to FIG. 13, in certain embodiments, the device 100 for brightness compensation of the display panel may further include an optimization unit 129.

The optimization unit 129 may be configured to obtain the optimized first gray-scale compensation value and the optimized second gray-scale compensation value by multiplying the first gray-scale compensation value and the second gray-scale compensation value by the corresponding optimization coefficients of the first gray-scale value and the second gray-scale value, respectively.

Figure 14:
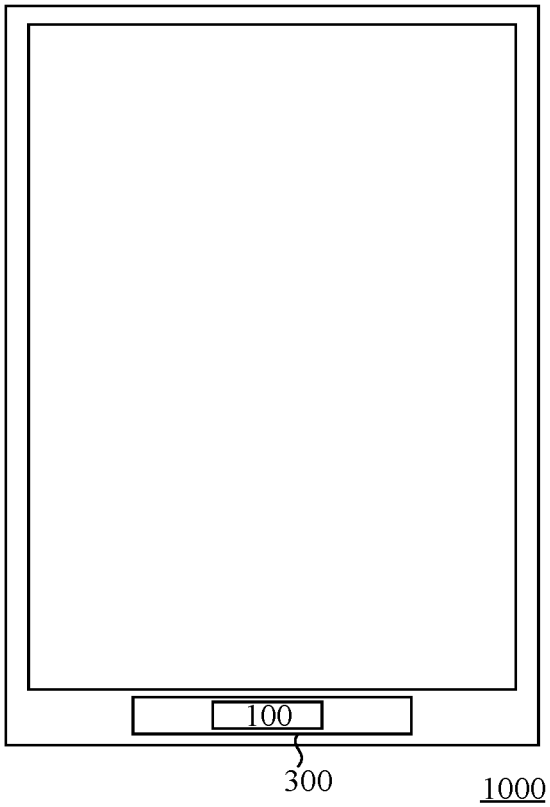
FIG. 14 illustrates a schematic structural diagram of an exemplary display device consistent with disclosed embodiments of the present disclosure.

The present disclosure also provides a display device. The display device may include an electronic device with a display function such as a mobile phone, or a tablet computer, etc. The display device may include the device for brightness compensation of the display panel in any one of the foregoing disclosed embodiments. FIG. 14 illustrates a schematic structural diagram of a display device consistent with disclosed embodiments of the present disclosure. The display device 1000 may include a driving chip 300. The driving chip 300 may be an integrated circuit (IC). In one embodiment, each functional unit of the device 100 for brightness compensation of the display panel in any one of the foregoing disclosed embodiments may be integrated in the driving chip 300.

The present disclosure also provides a computer-readable storage medium on which computer program instructions are stored. When the computer program instructions are executed by a processor, the method for brightness compensation of the display panel in any one of above-disclosed embodiments may be achieved. The program or code segment may be stored in a machine-readable medium, or may be transmitted on a transmission medium or communication link through a data signal carried by a carrier wave. The machine-readable medium may include any medium that is capable of storing or transmitting information. For example, the machine-readable medium may include an electronic circuit, a semiconductor memory device, read-only memory (ROM), flash memory, erasable ROM (EROM), a floppy disk, CD-ROM, an optical disk, a hard disk, a fiber optic medium, a radio frequency (RF) link, etc. The code segment may be downloaded through a computer network such as the Internet, an intranet, etc. In the disclosed embodiments of the present disclosure, the computer-readable storage medium may be a non-transitory computer-readable storage medium.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments illustrated herein but is to be accorded the widest scope consistent with the principles and novel features disclosed herein.

What is claimed is:

1. A method for brightness compensation of a display panel, comprising:

obtaining a brightness degradation rate of each sub-pixel of a plurality of sub-pixels of the display panel at a first gray-scale value, wherein the brightness degradation rate is a ratio of an attenuated brightness value over an original maximum brightness value of a sub-pixel at the first gray-scale value, the original maximum brightness value is an initial brightness value of the sub-pixel at the first gray-scale value, and the attenuated brightness value is a difference between the original maximum brightness value and a current brightness value of the sub-pixel at the first gray-scale value;

determining whether brightness degradation rates of the plurality of sub-pixels include a brightness degradation rate greater than a first preset threshold, and whether a proportion of sub-pixels, having brightness degradation rates greater than the first preset threshold, over the plurality of sub-pixels is greater than a preset percentage; and in response to the proportion of the sub-pixels, having the brightness degradation rates greater than the first preset threshold, over the plurality of sub-pixels being not greater than the preset percentage, performing brightness compensation on the display panel according to a first brightness compensation method, or in response to the proportion of the sub-pixels, having the brightness degradation rates greater than the first preset threshold, over the plurality of sub-pixels being greater than the preset percentage, performing brightness compensation on the display panel according to a second brightness compensation method, wherein:

the first brightness compensation method includes increasing brightness of at least a portion of the plurality of sub-pixels in the display panel, and the second brightness compensation method includes reducing brightness of at least a portion of the plurality of sub-pixels in the display panel.

2. The method according to claim 1, before obtaining the brightness degradation rate of each sub-pixel of the display panel at the first gray-scale value, further including:

calculating the brightness degradation rate of each sub-pixel at the first gray-scale value according to a first equation: $Dege=(L_o-L_{current})/L_o$; and storing the brightness degradation rate of each sub-pixel at the first gray-scale value calculated according to the first equation in a memory of the display panel, wherein:

Dege is the brightness degradation rate of the sub-pixel at the first gray-scale value, $L_o$ is the original maximum brightness value of the sub-pixel at the first gray-scale value, $L_{current}$ is the current brightness value of the sub-pixel at the first gray-scale value, $L_o-L_{current}$ is the attenuated brightness value of the sub-pixel at the first gray-scale value, and the current brightness value is a brightness value of the sub-pixel after the brightness is attenuated.

3. The method according to claim 2, before calculating the brightness degradation rate of each sub-pixel at the first gray-scale value, further including:

obtaining a current degradation duration of each sub-pixel and a correspondence relationship between brightness value and degradation duration of each sub-pixel at the first gray-scale value;

determining a brightness value corresponding to each current degradation duration according to the correspondence relationship between the brightness value and the degradation duration; and setting the brightness value corresponding to each current degradation duration as the current brightness value of each sub-pixel at the first gray-scale value.

4. The method according to claim 3, before obtaining the current degradation duration of each sub-pixel, further including:

according to a total display duration of each sub-pixel at each gray-scale value and a preset influence coefficient of each sub-pixel at each gray-scale value, determining the current degradation duration of each sub-pixel.

5. The method according to claim 4, wherein determining the current degradation duration of each sub-pixel includes:

after each display completion of the display panel, or after a ratio of a current brightness value of the sub-pixel at a current moment over a current brightness value of the sub-pixel at a beginning of each display is less than a second preset threshold, according to the total display duration of each sub-pixel at each gray-scale value and the preset influence coefficient of each sub-pixel at each gray-scale value, determining the current degradation duration of each sub-pixel; and updating the determined current degradation duration of each sub-pixel in the memory of the display panel.

6. The method according to claim 1, wherein performing the brightness compensation on the display panel according to the first brightness compensation method includes:

setting a sub-pixel having a brightness degradation rate greater than 0 as a to-be-compensated sub-pixel; and increasing brightness of the to-be-compensated sub-pixel, to provide an increased brightness value of the to-be-compensated sub-pixel same as an original maximum brightness value of the to-be-compensated sub-pixel at the first gray-scale value.

7. The method according to claim 6, before increasing the brightness of the to-be-compensated sub-pixel, further including:

according to the first gray-scale value and a correspondence relationship between voltage value and gray-scale value of the to-be-compensated sub-pixel, determining a current voltage value corresponding to the first gray-scale value;

calculating a requisite voltage value of the to-be-compensated sub-pixel according to a second equation: $V_2=V_1\times(1+Dege')$;

according to the requisite voltage value and the correspondence relationship between the voltage value and the gray-scale value of the to-be-compensated sub-pixel, determining a requisite gray-scale value corresponding to the requisite voltage value; and according to a difference between the requisite gray-scale value and the first gray-scale value, determining the first gray-scale compensation value of the to-be-compensated sub-pixel at the first gray-scale value, wherein:

$V_2$ is the requisite voltage value, $V_1$ is the current voltage value, and

Dege' is the brightness degradation rate of the to-be-compensated sub-pixel.

8. The method according to claim 1, wherein performing the brightness compensation on the display panel according to the first brightness compensation method includes:

counting proportions of sub-pixels with different brightness degradation rates;

setting a sub-pixel with a greatest proportion as a target sub-pixel, and setting the sub-pixels other than the target sub-pixel as to-be-compensated sub-pixels; and increasing brightness of a first to-be-compensated sub-pixel in the to-be-compensated sub-pixels, and reducing brightness of a second to-be-compensated sub-pixel in the to-be-compensated sub-pixels, such that the increased brightness of the first to-be-compensated sub-pixel and the reduced brightness of the second to-be-compensated sub-pixel are same as brightness of the target sub-pixel, wherein:

a brightness degradation rate of the first to-be-compensated sub-pixel is greater than a brightness degradation rate of the target sub-pixel, and a brightness degradation rate of the second to-be-compensated sub-pixel is less than the brightness degradation rate of the target sub-pixel.

9. The method according to claim 8, before increasing the brightness of the first to-be-compensated sub-pixel and reducing the brightness of the second to-be-compensated sub-pixel, further including:

according to the first gray-scale value and the correspondence relationship between the voltage value and the gray-scale value of the to-be-compensated sub-pixel, determining a current voltage value corresponding to the first gray-scale value;

calculating requisite voltage values of the first to-be-compensated sub-pixel and the second to-be-compensated sub-pixel, respectively, according to a third equation: $V_3=V_1\times(1+Dege_1-Dege_o)$ and a fourth equation: $V_4=V_1\times(1+Dege_2-Dege_o)$;

according to the requisite voltage values of the first to-be-compensated sub-pixel and the second to-be-compensated sub-pixel and the correspondence relationship between the voltage value and the gray-scale value of the display panel, determining requisite gray-scale values corresponding to the requisite voltage values of the first to-be-compensated sub-pixel and the second to-be-compensated sub-pixel; and according to a difference between the requisite gray-scale values and the first gray-scale value, determining first gray-scale compensation values of the first to-be-compensated sub-pixel and the second to-be-compensated sub-pixel at the first gray-scale value, wherein:

$V_3$ is the requisite voltage value of the first to-be-compensated sub-pixel, $V_1$ is the current voltage value, $Dege_o$ is the brightness degradation rate of the target sub-pixel, $Dege_1$ is the brightness degradation rate of the first to-be-compensated sub-pixel, $V_4$ is the requisite voltage value of the second to-be-compensated sub-pixel, and $Dege_2$ is the brightness degradation rate of the second to-be-compensated sub-pixel.

10. The method according to claim 1, wherein performing the brightness compensation on the display panel according to the second brightness compensation method includes:

setting the sub-pixel with a greatest brightness degradation rate as a target sub-pixel, and setting the sub-pixel other than the target sub-pixel as a to-be-compensated sub-pixel; and reducing brightness of the to-be-compensated sub-pixel, such that the reduced brightness of the to-be-compensated sub-pixel is same as brightness of the target sub-pixel.

11. The method according to claim 10, before reducing the brightness of the to-be-compensated sub-pixel, further including:

according to the first gray-scale value and the correspondence relationship between voltage value and gray-scale value of the to-be-compensated sub-pixel, determining a current voltage value corresponding to the first gray-scale value;

calculating a requisite voltage value of the to-be-compensated sub-pixel according to a fifth equation: $V_5=V_1\times(1+Dege_3-Dege_o)$;

according to the requisite voltage value and the correspondence relationship between the voltage value and the gray-scale value of the display panel, determining a requisite gray-scale value corresponding to the requisite voltage value; and according to a difference between the requisite gray-scale value and the first gray-scale value, determining a first gray-scale compensation value of the to-be-compensated sub-pixel at the first gray-scale value, wherein:

$V_5$ is the requisite voltage value of the to-be-compensated sub-pixel, $V_1$ is the current voltage value, $Dege_o$ is the brightness degradation rate of the target sub-pixel, and $Dege_3$ is the brightness degradation rate of the to-be-compensated sub-pixel.

12. The method according to claim 7, after determining the first gray-scale compensation value at the first gray-scale value, further including:

according to a linear interpolation method, based on the first gray-scale value and the first gray-scale compensation value, determining a second gray-scale compensation value of the to-be-compensated sub-pixel at a second gray-scale value.

13. The method according to claim 12, further including:

by multiplying the first gray-scale compensation value by an optimization coefficient corresponding to the first gray-scale value, obtaining an optimized first gray-scale compensation value; and by multiplying the second gray-scale compensation value by an optimization coefficient corresponding to the second gray-scale value, obtaining an optimized second gray-scale compensation value.

14. A device for brightness compensation of a display panel, comprising:

a brightness degradation rate acquisition unit, configured to obtain a brightness degradation rate of each sub-pixel of a plurality of sub-pixels of the display panel at a first gray-scale value, wherein:

the brightness degradation rate is a ratio of an attenuated brightness value over an original maximum brightness value of a sub-pixel at the first gray-scale value, the original maximum brightness value is an initial brightness value of the sub-pixel at the first gray-scale value, and the attenuated brightness value is a difference between the original maximum brightness value and a current brightness value of the sub-pixel at the first gray-scale value;

a determination unit, configured to determine whether brightness degradation rates of the plurality of sub-pixels include a brightness degradation rate greater than a first preset threshold, and whether a proportion of sub-pixels, having brightness degradation rates greater than the first preset threshold, over the plurality of sub-pixels is greater than a preset percentage; and a compensation unit, configured to:

in response to the proportion of the sub-pixels, having the brightness degradation rates greater than the first preset threshold, over the plurality of sub-pixels being not greater than the preset percentage, perform brightness compensation on the display panel according to a first brightness compensation method, or in response to the proportion of the sub-pixels, having the brightness degradation rates greater than the first preset threshold, over the plurality of sub-pixels being greater than the preset percentage, perform brightness compensation on the display panel according to a second brightness compensation method, wherein:

the first brightness compensation method includes increasing brightness of at least a portion of the plurality of sub-pixels in the display panel, and the second brightness compensation method includes reducing brightness of at least a portion of the plurality of sub-pixels in the display panel.

15. The device according to claim 14, further including:

a brightness degradation rate calculation unit, configured to calculate the brightness degradation rate of each sub-pixel at the first gray-scale value.

16. The device according to claim 15, further including:

a current brightness value determination unit, configured to:

obtain a current degradation duration of each sub-pixel and a correspondence relationship between brightness value and degradation duration of each sub-pixel at the first gray-scale value, determine a brightness value corresponding to each current degradation duration according to the correspondence relationship between the brightness value and the degradation duration, and set the brightness value corresponding to each current degradation duration as the current brightness value of each sub-pixel at the first gray-scale value.

17. The device according to claim 16, further including:

a current degradation duration determination unit, configured to according to a total display duration of each sub-pixel at each gray-scale value and a preset influence coefficient of each sub-pixel at each gray-scale value, determine the current degradation duration of each sub-pixel.

18. The device according to claim 14, further including:

a first gray-scale compensation value determination unit, configured to:

according to the first gray-scale value and a correspondence relationship between voltage value and gray-scale value of the sub-pixel, determine a current voltage value corresponding to the first gray-scale value;

calculate a requisite voltage value of the sub-pixel;

according to the requisite voltage value and the correspondence relationship between the voltage value and the gray-scale value of the sub-pixel, determine a requisite gray-scale value corresponding to the requisite voltage value; and according to a difference between the requisite gray-scale value and the first gray-scale value, determine the first gray-scale compensation value of the sub-pixel at the first gray-scale value.

19. The device according to claim 18, further including:

a second gray-scale compensation value determination unit, configured to according to a linear interpolation method, determine the second gray-scale compensation value of the to-be-compensated sub-pixel at the second gray-scale value based on the first gray-scale value and the first gray-scale compensation value.

20. A display device, comprising:

a device for brightness compensation of a display panel, wherein the device includes:

a brightness degradation rate acquisition unit, configured to obtain a brightness degradation rate of each sub-pixel of a plurality of sub-pixels of the display panel at a first gray-scale value, wherein:

the brightness degradation rate is a ratio of an attenuated brightness value over an original maximum brightness value of a sub-pixel at the first gray-scale value, the original maximum brightness value is an initial brightness value of the sub-pixel at the first gray-scale value, and the attenuated brightness value is a difference between the original maximum brightness value and a current brightness value of the sub-pixel at the first gray-scale value;

a determination unit, configured to determine whether brightness degradation rates of the plurality of sub-pixels include a brightness degradation rate greater than a first preset threshold, and whether a proportion of sub-pixels, having brightness degradation rates greater than the first preset threshold, over the plurality of sub-pixels is greater than a preset percentage; and a compensation unit, configured to:

in response to the proportion of the sub-pixels, having the brightness degradation rates greater than the first preset threshold, over the plurality of sub-pixels being not greater than the preset percentage, perform brightness compensation on the display panel according to a first brightness compensation method, or in response to the proportion of the sub-pixels, having the brightness degradation rates greater than the first preset threshold, over the plurality of sub-pixels being greater than the preset percentage, perform brightness compensation on the display panel according to a second brightness compensation method, wherein:

the first brightness compensation method includes increasing brightness of at least a portion of the plurality of sub-pixels in the display panel, and the second brightness compensation method includes reducing brightness of at least a portion of the plurality of sub-pixels in the display panel.

* * * * *